US007512361B2

(12) United States Patent
Kawamura et al.

(10) Patent No.: US 7,512,361 B2
(45) Date of Patent: Mar. 31, 2009

(54) PROCESS CARTRIDGE WHOSE DEVELOPING ROLLER AND DRUM CONTACT AND SEPARATE FROM EACH OTHER AND IMAGE FORMING APPARATUS USING SUCH CARTRIDGE

(75) Inventors: Hiroshi Kawamura, Shizuoka-ken (JP); Susumu Nittani, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 401 days.

(21) Appl. No.: 11/405,480

(22) Filed: Apr. 18, 2006

(65) Prior Publication Data

US 2006/0245785 A1 Nov. 2, 2006

(30) Foreign Application Priority Data

Apr. 27, 2005 (JP) ..... 2005-130612
Mar. 23, 2006 (JP) ..... 2006-080696

(51) Int. Cl.
*G03G 21/18* (2006.01)

(52) U.S. Cl. ..... 399/111; 399/113

(58) Field of Classification Search ..... 399/12, 399/13, 111, 113, 116, 119
See application file for complete search history.

(56) References Cited

U.S. PATENT DOCUMENTS 6,459,869 B2 10/2002 Nittani et al. ..... 399/111
6,463,234 B2 10/2002 Arimitsu et al. ..... 399/113
6,681,088 B2 1/2004 Kanno et al. ..... 399/111
6,834,171 B2 12/2004 Nittani et al. ..... 399/103
6,947,686 B2 * 9/2005 Kawai et al. ..... 399/111
6,980,758 B2 12/2005 Murayama et al. ..... 399/111
7,024,137 B2 4/2006 Nittani et al. ..... 399/222
7,027,756 B2 4/2006 Hoshi et al. ..... 399/111
7,072,603 B2 7/2006 Tsuzuki et al. ..... 399/111
7,088,938 B2 8/2006 Hashimoto et al. ..... 399/103
7,088,939 B2 8/2006 Maeshima et al. ..... 399/111
7,142,796 B2 * 11/2006 Hymas et al. ..... 399/111

(Continued)

FOREIGN PATENT DOCUMENTS

JP 2001-337511 A 12/2001

(Continued)

OTHER PUBLICATIONS

U.S. Appl. No. 11/137,577, filed May 26, 2006, Masatomo Tsuzuki et al.

*Primary Examiner*—William J Royer
(74) *Attorney, Agent, or Firm*—Fitzpatrick, Cella, Harper & Scinto

(57) ABSTRACT

A process cartridge transportable when mounted in a main assembly of an electrophotographic image forming apparatus. The cartridge includes an electrophotographic photosensitive drum, a developing roller for developing an electrostatic latent image on the drum when in contact with the drum, a drum unit supporting the drum, a developing unit supporting the roller and connected with the drum unit for rotation between a contact position in contact with the drum and a separated position, a force receiving portion for receiving, from the main assembly, a force for moving the developing unit from the contact to the separated position, with the cartridge mounted in the main assembly, a separation member for maintaining the developing unit at a position where the developing roller and the drum are separated from each other, and a detection portion to detect the mounting of the separation member when the cartridge mounted in the main assembly.

10 Claims, 19 Drawing Sheets

U.S. PATENT DOCUMENTS

| | | | | |
|---|---|---|---|---|
| 7,272,339 | B2 * | 9/2007 | Tsuzuki et al. | 399/111 |
| 2005/0115043 | A1 | 6/2005 | Maeshima et al. | 29/402.08 |
| 2005/0260011 | A1 | 11/2005 | Murayama et al. | 399/111 |
| 2006/0013618 | A1 | 1/2006 | Nittani et al. | 399/222 |
| 2006/0177231 | A1 | 8/2006 | Mori et al. | 399/12 |

FOREIGN PATENT DOCUMENTS

| | | | |
|---|---|---|---|
| JP | 2002-6722 | A | 1/2002 |

* cited by examiner

PROCESS CARTRIDGE WHOSE DEVELOPING ROLLER AND DRUM CONTACT AND SEPARATE FROM EACH OTHER AND IMAGE FORMING APPARATUS USING SUCH CARTRIDGE

FIELD OF THE INVENTION AND RELATED ART

The present invention relates to a process cartridge, and an electrophotographic image forming apparatus in which a process cartridge is removably mountable.

Here, an electrophotographic image forming apparatus means an apparatus which forms an image on recording medium (for example, a sheet of recording paper, a sheet for OHP, etc.), with the use of an electrophotographic image forming method. As examples of an electrophotographic image forming apparatus, an electrophotographic copying machine, an electrophotographic printer (an LED printer, a laser beam printer), a word processor, a facsimile machine, and the like can be included.

A process cartridge is a cartridge in which at least an electrophotographic photosensitive member, and a development roller are integrally disposed, and which is removably mountable in the main assembly of an electrophotographic image forming apparatus. A development roller is a processing means which processes an electrophotographic photosensitive member.

In the field of an electrophotographic image forming apparatus, it has been a common practice to employ a process cartridge system, according to which an electrophotographic photosensitive drum and a development roller are integrally disposed in a cartridge which is removably mountable in the main assembly of an image forming apparatus. A development roller is a roller for developing an electrostatic latent image formed on an electrophotographic photosensitive drum. Further, a process cartridge system makes it possible for a user to maintain an image forming apparatus, instead of relying on service personnel. This is why a process cartridge has been widely used in the field of an electrophotographic image forming apparatus.

Also in the field of an electrophotographic image forming apparatus, a developing method of the contact type has been known, which is such a developing method that develops the above-mentioned electrostatic latent image with the use of developer, with an electrophotographic photosensitive drum and a development roller placed in contact with each other, and also, in parallel to their lengthwise direction.

When process cartridges (which hereinafter will be referred to simply as cartridges) in accordance with the above described developing method of the contact type are used with an electrophotographic full-color image forming apparatus, a developer image (image formed of developer) of cyan color, a developer image of magenta color, a developer image of yellow color, and a developer image of black color are formed on the photosensitive drums which the cartridges have, one for one. These developer images are transferred in layers onto a recording medium, forming thereby a single full-color image on the recording medium. However, this method suffers from the following problem: if the photosensitive drum and development roller are kept in contact with each other even during periods other than the period in which an image is actually formed, it is possible that their service lives will be reduced due to frictional wear.

Further, if the two are kept in contact with each other after the shipment of a process cartridge from a factory, it is possible that the contact pressure between the two will cause permanent damage to the two. It is also possible that during the shipment of a cartridge, the photosensitive drum and development roller will rub against each other due to the vibrations which occur during the shipment of the cartridge, the impacts which result as the cartridge is dropped during the shipment of the cartridge, or the like causes.

As one of the attempts which have been made to solve the above described problems, there is the structural arrangement disclosed in Japanese Laid-open Patent Application 2001-337511, according to which when a cartridge is in the main assembly of an image forming apparatus, the photosensitive drum and development roller in the cartridge are kept separated from each other, except for the period in which an image is actually formed. Further, Japanese Laid-open Patent Application 2002-6722 discloses a structural arrangement which keeps the photosensitive drum and development roller separated while a process cartridge is transported.

In recent years, it has been thought that an image forming apparatus could be shipped with a cartridge mounted in the image forming apparatus. This method of shipping an image forming apparatus can reduce the cost for shipping a cartridge (or cartridges) and an image forming apparatus to a user from a factory, because this method of shipping substantially decreases the amount of the space the cartridge (cartridges) and the main assembly of an image forming apparatus occupy for their shipment as compared to the shipping method in which the cartridge (cartridges) and the main assembly of an image forming apparatus are separately packaged.

SUMMARY OF THE INVENTION

Each of the structural arrangements disclosed in the above-mentioned documents displays excellent effects. However, in the cases of these structural arrangements, it has not been taken into consideration that an image forming apparatus is transported with a cartridge (cartridges) mounted in the main assembly of the image forming apparatus.

Thus, the primary object of the present invention is to provide a process cartridge which can be safely transported while being kept mounted in the main assembly of an electrophotographic image forming apparatus, and an electrophotographic image forming apparatus in which such a process cartridge is removably mountable.

Another object of the present invention is to provide a process cartridge which allows the separating members remaining attached thereto to be detected before an image forming operation is started, and an electrophotographic image forming apparatus in which such a process cartridge is removably mountable. Here, the separating member is a member which is attached to a process cartridge to separate, and keep separated, the photosensitive member and development roller from each other.

Another object of the present invention is to provide a process cartridge which is not usable for an image forming operation when the separating members are remaining attached thereto, and an electrophotographic image forming apparatus in which such a process cartridge is removably mountable.

Another object of the present invention is to provide a process cartridge, which is removably mountable in an apparatus main assembly of an electrophotographic image forming apparatus for forming an image on recording medium, and is transportable while remaining mounted in the apparatus main assembly, comprising:

an electrophotographic photosensitive drum;

a development roller for developing an electrostatic latent image formed on the electrophotographic photosensitive drum, with the use of developer, by being placed in parallel to the lengthwise direction of the electrophotographic photosensitive drum, and in contact with the electrophotographic photosensitive drum;

a drum unit which supports the electrophotographic photosensitive drum;

a development unit which supports the development roller, and is rotatably connected to the drum unit so that the development roller is allowed to move into a contact position in which it keeps the development roller in contact with the electrophotographic photosensitive drum, across its entire range in terms of the direction parallel to the lengthwise direction of the electrophotographic photosensitive drum, and a separation position in which it keeps the development roller and electrophotographic photosensitive drum separated from each other;

a force catching portion which catches the force applied from the apparatus main assembly to move the development unit from the contact position to the separation position, when the process cartridge is in the apparatus main assembly;

separating members which are removably attached to the drum unit and development unit to keep the development unit in the separation position in which the development unit keeps the development roller and the electrophotographic photosensitive drum separated, and which do not interfere with the mounting of the process cartridge into the apparatus main assembly even when the process cartridge is mounted into the apparatus main assembly with the separating members remaining attached to the process cartridge; and a detecting portion which enables the apparatus main assembly to detect the separating members remaining attached to the process cartridge in the apparatus main assembly.

Another object of the present invention is to provide an electrophotographic image forming apparatus which allows a process cartridge to be removably mounted in a main assembly thereof, is transportable with the process cartridge mounted in the main assembly, and forms an image on recording medium, comprising:

(a) detecting means;

(b) force applying means, which is movable attached;

(c) process cartridges comprising: an electrophotographic photosensitive drum; a development roller for developing an electrostatic latent image formed on the electrophotographic photosensitive drum, with the use of developer, by being placed in parallel to the lengthwise direction of the electrophotographic photosensitive drum, and in contact with the electrophotographic photosensitive drum; a drum unit which supports the electrophotographic photosensitive drum; a development unit which supports the development roller, and is rotatably connected to the drum unit so that the development roller is allowed to move into a contact position in which it keeps the development roller in contact with the electrophotographic photosensitive drum, across its entire range in terms of the direction parallel to the lengthwise direction of the electrophotographic photosensitive drum, and a separation position in which it keeps the development roller and electrophotographic photosensitive drum separated from each other; a force catching portion which catches the force applied from the main assembly to move the development unit from the contact position to the separation position, when the process cartridge is in the main assembly; separating members which are removably attached to the drum unit and development unit to keep the development unit in the separation position in which the development unit keeps the development roller and electrophotographic photosensitive drum separated, and which do not interfere with the mounting of the process cartridge into the main assembly even when the process cartridge is mounted into the main assembly with the separating members remaining attached to the process cartridge; and a detecting portion which enables the main assembly to detect the separating members remaining attached to the process cartridge in the main assembly;

(d) mounting members for removably mounting the process cartridge; and (e) conveying means for conveying the recording medium.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

Figure 1:
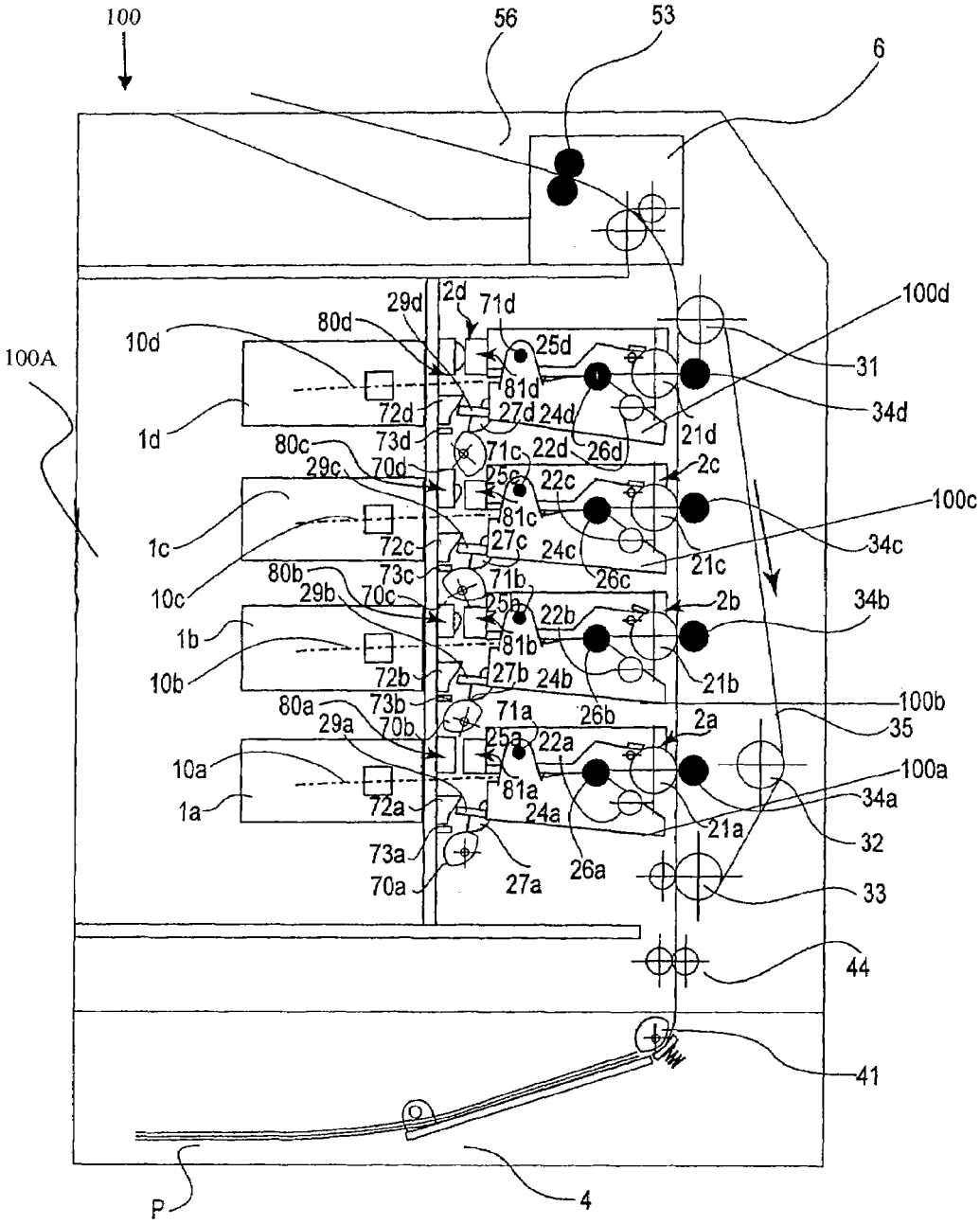
FIG. 1 is a sectional view of an image forming apparatus (which is on standby) in the first embodiment of the present invention, showing the general structure thereof.

Next, the electrophotographic image forming apparatus in the first embodiment of the present invention will be described with reference to the appended drawings. FIG. 1 is a sectional view of a color laser printer, as an example of an electrophotographic color image forming apparatus, in the first embodiment of the present invention, showing the general structure thereof.

[General Structure of Image Forming Apparatus]

First, referring to FIG. 1, the general structure of the color image forming apparatus will be described. The image forming apparatus 100 has: cartridge bays (100*a*, 100*b*, 100*c*, and 100*d*), in which cartridges are removably mountable; detection levers 72*a*, 72*b*, 72*c*, and 72*d*; and sensors 73*a*, 73*b*, 73*c*, and 73*d*. Each sensor 73 as a detecting means detects whether or not separating members (separation members) 71*a*, 71*b*, 71*c*, and 71*d* are remaining on the cartridge 2*a*, 2*b*, 2*c*, and 2*d*, when the cartridge 2*a*, 2*b*, 2*c*, and 2*d* is mounted into an apparatus main assembly 100A. The structures of the abovementioned components will be described later in detail.

The apparatus main assembly 100A of the color laser printer as an example of the image forming apparatus is structured so that four cartridges 2 (2*a*, 2*b*, 2*c*, and 2*d*) different in the color of the toner therein can be independently and removably mountable in the apparatus main assembly 100A, making it possible for an operator of the image forming apparatus to easily replace each cartridge 2 independently, as the cartridge 2 becomes depleted of the developer therein by consumption. More specifically, the apparatus main assembly 100A of the image forming apparatus is provided with cartridge bays 100*a*, 100*b*, 100*c*, and 100*d*, listing from bottom one to top, which are vertically stacked. The cartridge 2*a*, which is to be mounted into the cartridge bay 100*a*, stores the developer of magenta (M) color. It develops an electrostatic latent image formed on an electrophotographic photosensitive member 21*a* (which hereinafter will be referred to as photosensitive drum 21) in the form of a drum, with the use of the developer of magenta color. The photosensitive drum 21 will be described later. A cartridge 2*b* which is to be mounted into the cartridge bay 100*b* stores the developer of cyan (C) color, and develops the abovementioned electrostatic latent image, with the use of the developer of cyan color. A cartridge 2*c* which is to be mounted into the cartridge bay 100*c* stores the developer of yellow (Y) color, and develops the abovementioned electrostatic latent image, with the use of the developer of yellow color. A cartridge 2*d* which is to be mounted into the cartridge bay 100*d* stores the developer of black (Bk) color, and develops the abovementioned electrostatic latent image, with the use of the developer of black color.

Here, the apparatus main assembly 100A is the entirety of the portion of the image forming apparatus, which does not include the process cartridge 2.

The image forming apparatus main assembly 100A is provided with scanner portions 1*a*, 1*b*, 1*c*, and 1*d*, a recording medium feeder cassette 4, a fixing portion 6, a driver roller 31, follower rollers 32 and 33, a transfer roller 34*a*, 34*b*, 34*c*, and 34*d*, a conveyer belt 35, a feeder roller 41, and a pair of registration rollers 44.

Each transfer roller 34*a*, 34*b*, 34*c*, and 34*d* is positioned so that it opposes the corresponding photosensitive drum 21 (21*a*, 21*b*, 21*c*, and 21*d*), with the conveyer belt 35 pinched between the transfer roller 34*a*, 34*b*, 34*c*, and 34*d* and photosensitive drum 21. As voltage is applied to the transfer roller 34*a*, 34*b*, 34*c*, and 34*d*, the developer image formed on the photosensitive drum 21 is transferred onto recording medium P (sheet of recording paper, sheet for OHP, etc.). The photosensitive drum 21 and transfer roller 34*a*, 34*b*, 34*c*, and 34*d* make up a transfer portion (nip).

The conveyer belt 35 is supported by three rollers, that is, the driver roller 31 and follower rollers 32 and 33, with the axial line of the driver roller 31 functioning as a pivotal axis. The conveyer belt 35 is circularly moved in the clockwise direction indicated by an arrow mark in the drawing, in synchronism with the progression of an image forming operation, by the driving force transmitted to the driver roller 31. The photosensitive drum 21 is rotated in the direction indicated by an arrow mark in the drawing, at a preset peripheral velocity (which hereinafter will be referred to as process speed), which is the same as the speed at which the conveyer belt 35 is circularly moved.

Each scanner portion 1*a*, 1*b*, 1*c*, and 1*d* projects a beam of laser light 10*a*, 10*b*, 10*c*, and 10*d* while modulating it with image formation information. The peripheral surface of the photosensitive drum 21, which has just been uniformly charged, is exposed to the beam of laser light 10*a*, 10*b*, 10*c*, and 10*d*. As a result, an electrostatic latent image, which reflects the image formation information, is formed on the peripheral surface of the photosensitive drum 21. At the same time as this latent image is formed, a development roller (developing roller) 22 is driven, and as the development roller 22 is driven, a voltage which is the same in polarity and potential level as the developer is applied to the development roller 22. As a result, the electrostatic latent image, which has just been formed on the peripheral surface of the photosensitive drum 21, is developed by the developer. More specifically, the development roller 22 is placed in contact with, and in parallel to, the photosensitive drum 21, and the developer is used to develop the latent image on the photosensitive drum 21.

The feeder roller 41 feeds the recording mediums P in the feeder cassette 4 into the apparatus main assembly, while separating them one by one. Then, it conveys each recording medium P to the pair of registration rollers 44. The registration rollers 44 further convey the recording medium P with such timing that the recording medium P arrives at the transfer nip at the same time as a monochromatic developer image of the first color (magenta) arrives at the transfer nip. As the recording medium P reaches the conveyer belt 35, it is electrostatically held to the conveyer belt 35, and then, is conveyed to the transfer nip. In the transfer station T, the developer image on the peripheral surface of the photosensitive drum 21 is transferred onto the recording medium P which is remaining electrostatically adhered to the conveyer belt 35. In order to transfer the developer image from the photosensitive drum 21 onto the recording medium P, such voltage that is opposite in polarity to the developer image is applied to the transfer nip.

As the recording medium P is conveyed through the four transfer nips, four monochromatic developer images different in color are sequentially transferred in layers onto the recording medium P. As a result, a single full-color image is effected on the recording medium P. Then, the recording medium P, onto which the full-color image has just been transferred, is separated from the conveyer belt 35, and is sent to the fixing portion 6. In the fixing portion 6, the full-color image is fixed to the recording medium P. Thereafter, the recording medium P is discharged by a pair of discharge rollers 53 into a delivery tray 56 located on top of the apparatus main assembly.

[Process Cartridge]

Figure 2:
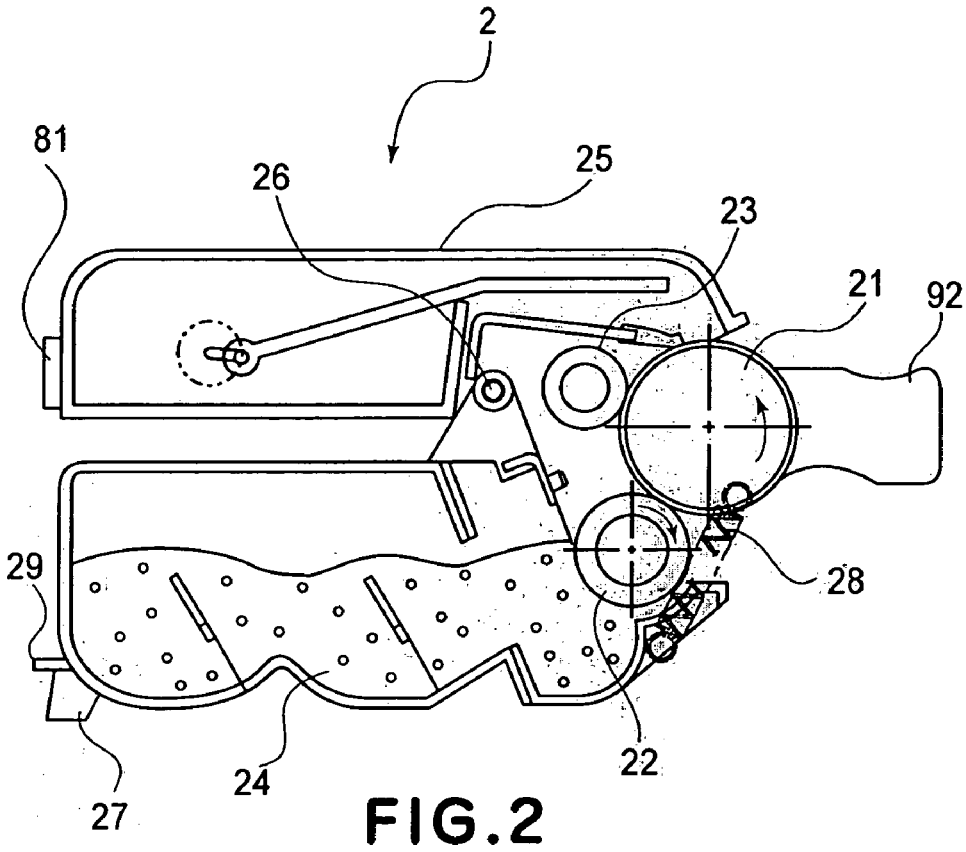
FIG. 2 is a cross-sectional view of a process cartridge (which is actually forming an image) in the first embodiment of the present invention.
Figure 3:
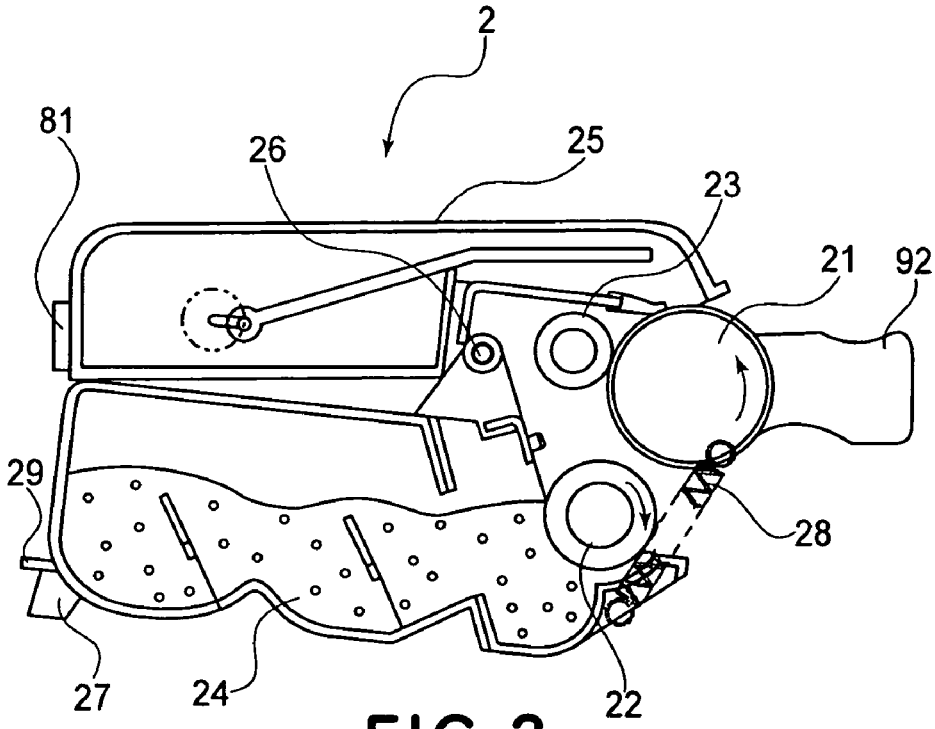
FIG. 3 is a cross-sectional view of the process cartridge (which is on standby) in the first embodiment of the present invention.
Figure 4:
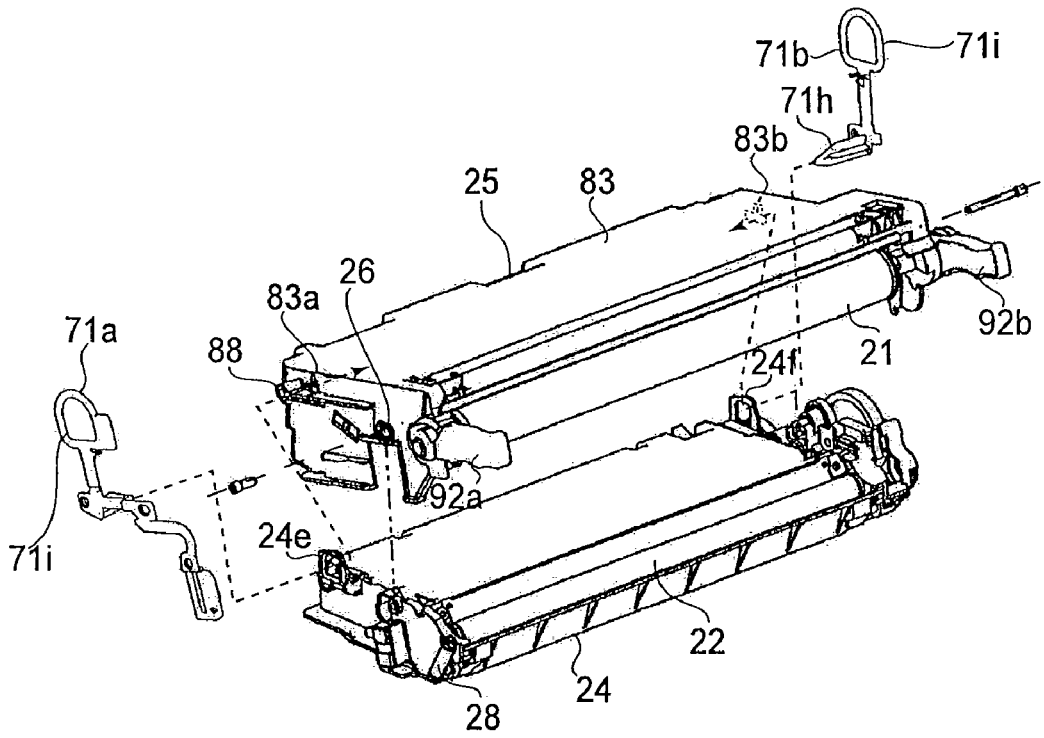
FIG. 4 is a sectional view of the process cartridge (which is actually forming an image) in the first embodiment of the present invention, showing the general structure thereof.

Referring to FIGS. 2-4, each cartridge 2 (2*a*, 2*b*, 2*c*, and 2*d*) has a development unit 24 (24*a*, 24*b*, 24*c*, and 24*d*) and a drum unit 25 (25*a*, 25*b*, 25*c*, and 25*d*), respectively. As a cartridge 2 is mounted into the apparatus main assembly 100A of the image forming apparatus, the drum unit 25 is correctly positioned relative to the apparatus main assembly 100A, and while the cartridge 2 is correctly positioned in the apparatus main assembly 100A, the drum unit 25 is kept correctly positioned relative to the apparatus main assembly 100A. The development unit 24 is connected to the drum unit 25 so that it is pivotally movable relative to the drum unit 25. That is, the development unit 24 is pivotally movable about connective pins put through a joint between the development unit 24 and drum unit 25. In the development unit 24, a development roller 22 (22*a*, 22*b*, 22*c*, and 22*d*) as a development member is rotatably supported. In the drum unit 25, a photosensitive drum 21 (21*a*, 21*b*, 21*c*, and 21*d*), and a charge roller 23 (FIG. 2) are rotatably supported. The development unit 24 is kept pressured by a pair of tension springs 28 as a pressure applying member so that the development roller 22 is kept pressured toward the photosensitive drum 21. That is, the tension springs 28 keep the development unit 24 pressured so that the photosensitive drum 21 and development roller 22 are placed in contact with each other across their entire ranges in terms of their lengthwise direction. Incidentally, the photosensitive drum 21 is made up of an aluminum cylinder, and a layer of an organic photoconductive substance coated across the entirety of the peripheral surface of the aluminum cylinder.

Figure 6:
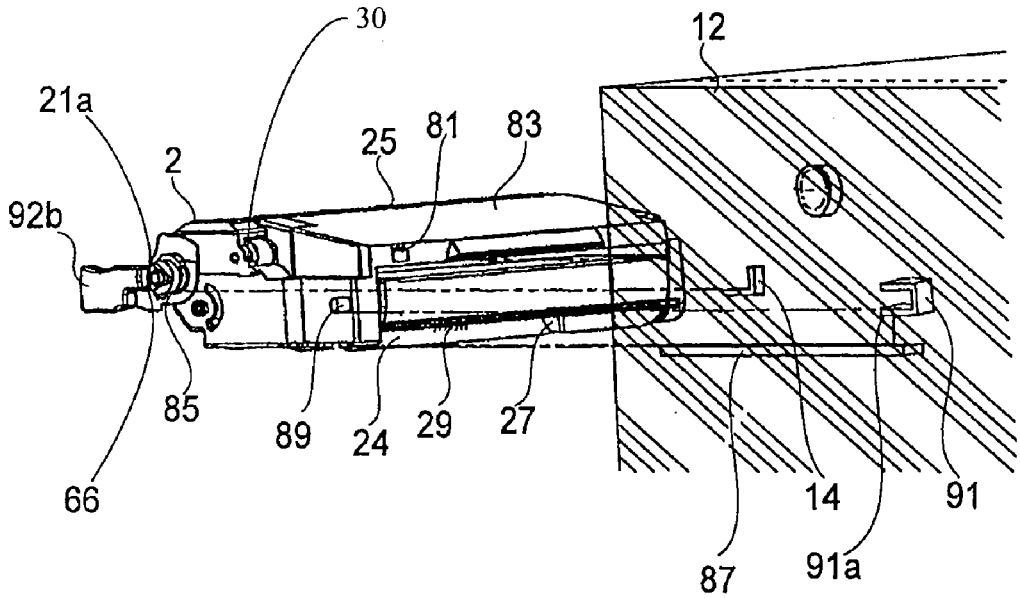
FIG. 6 is a perspective view of one of the essential portions of the image forming apparatus in the first embodiment of the present invention.
Figure 14:
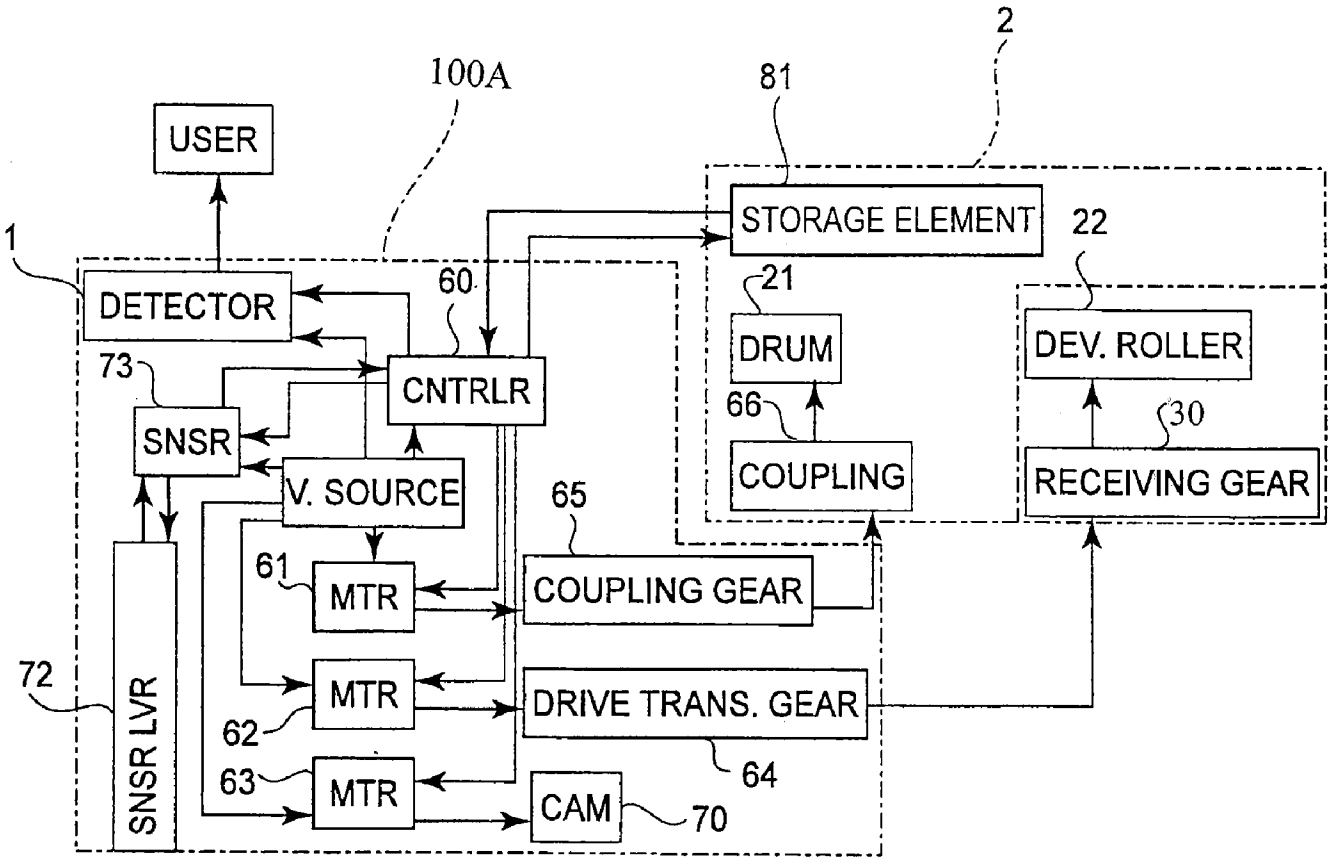
FIG. 14 is a block diagram of the image forming apparatus in the first embodiment of the present invention.

The photosensitive drum 21 is provided with a coupling 66, which is attached to one of the lengthwise ends of the photosensitive drum 21 (FIG. 6). To this coupling 66, driving force is transmitted from a motor 61 (FIG. 14), with which the apparatus main assembly 100A is provided, through a coupling gear 65 (FIG. 14), whereby the photosensitive drum 21 is rotated in the counterclockwise direction (FIGS. 2 and 3) in synchronism with the progression of an image forming operation. The cartridge 2 is provided with a driving force receiving gear 30 (FIG. 14). To this gear 30, driving force is transmitted from a motor 62 (FIG. 14), with which the apparatus main assembly 100A is provided, through a drive transmission gear 64 (FIG. 14), whereby the development roller 22 is rotated in synchronism with the progression of the image forming operation.

The cartridge 2 is provided with handgrips 92 (92*a* and 92*b*), which are for making it easier for an operator to handle the cartridge 2. They are attached to the lengthwise ends of the cartridge 2 one for one. In terms of the direction in which the cartridge 2 is mounted into the apparatus main assembly 100A (cartridge bays 100*a*, 100*b*, 100*c*, and 100*d*), the handgrips 92 are on the rear side (upstream side) of the cartridge 2. Incidentally, the cartridge 2 is mounted into, or removed from, the apparatus main assembly 100A, in the direction intersecting (perpendicular) the lengthwise direction of the cartridge 2. Here, the lengthwise direction of the cartridge 2 is the same direction as the lengthwise direction of the photosensitive drum 21.

Referring to FIGS. 2 and 3, the development unit 24 is attached to the drum unit 25 so that the development unit 24 is pivotally movable relative to the drum unit 25, and also, so that the development unit 24 is allowed to assume the contact position (shown in FIG. 2) in which the development roller 22 of the development unit 24 is kept in contact with the photosensitive drum 21 of the drum unit 25 across their entire lengthwise ranges, and the separation position in which the development roller 22 is kept separated from the photosensitive drum 21. Thus, when the development unit 24 is in the separation position, the development roller 22 and the photosensitive drum 21 remain separated from each other across their entire lengthwise ranges.

While the cartridge 2 is in the image forming apparatus, the development unit 24 is retained in either the contact or separation position. That is, the contact position is the position into which the development unit 24 is placed to ready the image forming apparatus for image formation (state shown in FIG. 2), whereas the separation position is the position into which the development unit 24 is placed to keep the photosensitive drum 21 and development roller 22 separated from each other, that is, to keep the image forming apparatus on standby (the state shown in FIG. 3). The operation and structural arrangement for placing, and keeping placed the cartridge 2 in the contact or separation position will be described in the section titled "Development Roller Separating Member".

Incidentally, the apparatus main assembly 100A and the cartridge 2 may be structured so that when the development unit 24 is in the separation position, the charge roller 23 is also kept separated from the photosensitive drum 21.

[Mounting of Process Cartridge into Main Assembly of Image Forming Apparatus, and Positioning of Process Cartridge Relative to Main Assembly]

Next, referring to FIGS. 5-7, the structural arrangement for mounting the cartridge 2 into the apparatus main assembly 100A, and the structural arrangement for correctly positioning the cartridge 2 in the apparatus main assembly 100A will be described.

Figure 5:
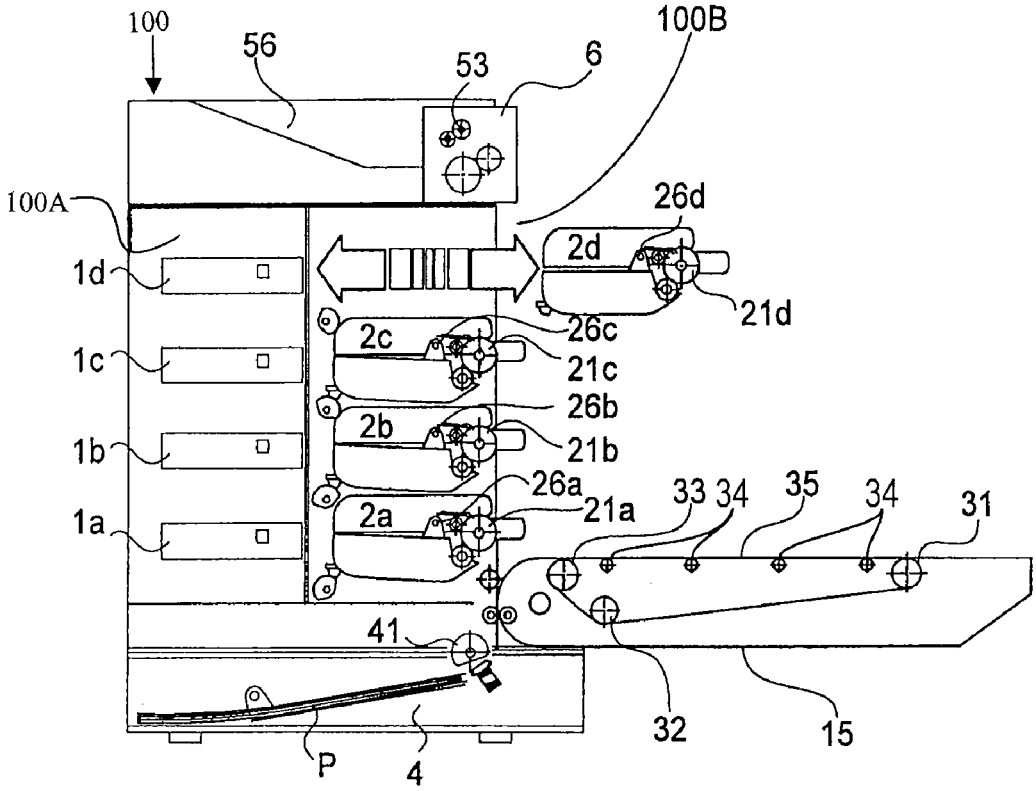
FIG. 5 is a sectional view of the image forming apparatus in the first embodiment of the present invention, showing the general structure thereof.

Referring to FIG. 5, the conveyer belt 35 and transfer roller 34 are disposed in the inwardly facing hollow of a door 15, and are attached to the door 15. The opening of the door 15 by an operator exposes an opening 100B (FIG. 5), through which the cartridge 2 is mounted into the apparatus main assembly 100A. The operator is to mount the cartridge 2 into, or remove the cartridge 2 from, the apparatus main assembly 100A through the opening 100B by gripping the handgrips 92. The door 15 can be locked in the closed position, in which it completely covers the opening 100B, or in the opening position, in which the opening 100B is fully exposed.

Figure 7:
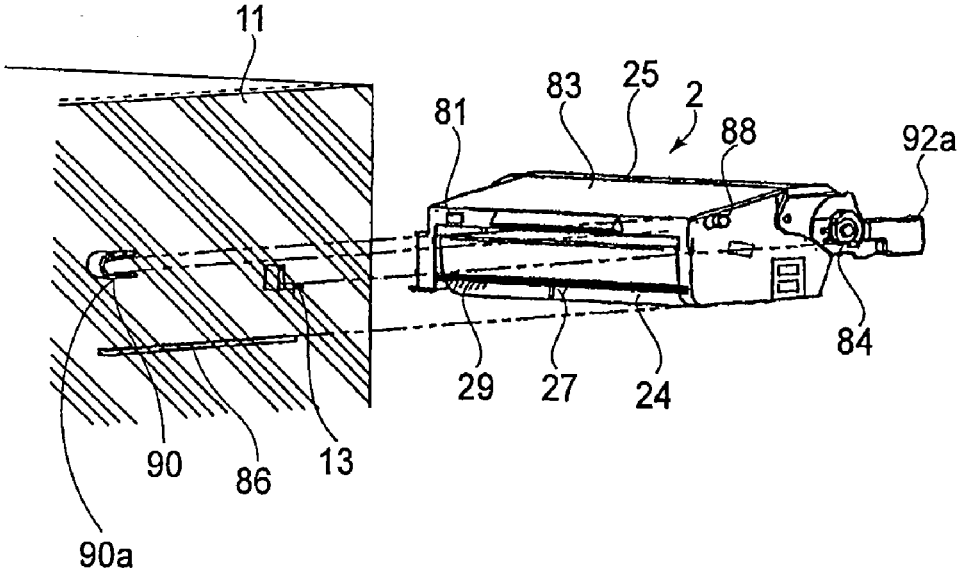
FIG. 7 is a perspective view of one of the essential portions of the image forming apparatus in the first embodiment of the present invention.

Referring to FIGS. 6 and 7, the drum unit 25 is provided with a pair of bearings 84 and 85, which are located at the lengthwise ends of the drum unit 25 one for one. More specifically, the bearings 84 and 85 support a shaft 21*a* of the photosensitive drum 21 by the lengthwise ends of the shaft 21*a* one for one. The bearing 84 and bearing 85 are attached to the lengthwise end walls of a frame 83 of the drum unit 25, one for one. The peripheral surfaces of these bearings 84 (first portion to be positioned) and 85 (second portion to be positioned) are correctly positioned relative to the apparatus main assembly 10A. More specifically, a part of the peripheral surface of the bearing 84 is the first portion to be positioned relative to the apparatus main assembly 100A, and a part of the peripheral surface of the bearing 85 is the second portion to be positioned relative to the apparatus main assembly 100A.

A first lateral plate 11 of the apparatus main assembly 100A is provided with a first positioning portion 13 for correctly positioning the bearing 84, and a second lateral plate 12 of the apparatus main assembly 100A is provided with a second positioning portion 14 for correctly positioning the bearing 85.

Referring to FIGS. 5-7, while the cartridge 2 is inserted into the apparatus main assembly 100A, the door 15 is kept open. The abovementioned first and second lateral plates 11 and 12 are provided with guiding portions 86 and 87, respectively. The guiding portions 86 and 87 guide the bearings 84 and 85 to the first and second positioning portions 13 and 14, respectively, of the apparatus main assembly 100A, by guiding the cartridge 2 along the bottom surface.

As the cartridge 2 is inserted up to a preset point in the apparatus main assembly 100A, the bearings 84 and 85 come into contact with the first and second positioning portions 13 and 14, respectively, whereby the photosensitive drum 21 is correctly disposed in a preset position in the apparatus main assembly 100A; the photosensitive drum 21 is correctly positioned relative to the apparatus main assembly 100A.

Further, the drum unit 25 is provided with bosses 88 and 89, as third and fourth portions to be used for correctly position the drum unit 25. The bosses 88 and 89 are attached to the lengthwise end surfaces of the drum unit 25, one for one. In terms of the direction in which the cartridge 2 is mounted into the apparatus main assembly 100A, the bosses 88 and 89 are located on the front (downstream) sides of the bearings 84 and 85, respectively. In terms of the lengthwise direction of the cartridge 2, the bosses 88 and 89 are on the lengthwise end surfaces of the frame 83 of the drum unit 25.

The abovementioned first and second lateral plates 11 and 12 are provided with third and fourth positioning portion 90 and 91, respectively.

As the cartridge 2 is inserted up to a preset point in the apparatus main assembly 100A, the bearings 84 and 85 come into contact with the first and second positioning portions 13 and 14, respectively, and at the same time, the bosses 88 and 89 come into contact with the third and fourth positioning portions 90 and 91, respectively, whereby the cartridge 2 is correctly positioned relative to the apparatus main assembly 100A. More precisely, the peripheral surfaces of the bearings 84 and 85 which support the shaft 21*a* of the photosensitive drum 21 are correctly positioned relative to the apparatus main assembly 100A. In other words, in this embodiment, first, the photosensitive drum 21 is correctly placed in the preset position in the apparatus main assembly 100A, and then, the cartridge 2 is correctly positioned relative to the apparatus main assembly 100A.

After coming into contact with the third and fourth positioning portions 90 and 91, the bosses 88 and 89 fit into grooves which the third and fourth positioning portions 90 and 91 form one for one, with the presence of a certain amount of play between the bosses 88 and 89 and the top surfaces 90*a* and 91*a* of the bottom portions of the third and fourth positioning portions 90 and 91, and are supported by the top surfaces 90*a* and 91*a*, respectively. All that is necessary for the cartridge 2 to be correctly positioned is that either the boss 88 or 89 is supported by the top surface 90*a* or 91*a*, respectively. Regarding the amount of the abovementioned plays, the play between the boss 88 and third positioning portion 90 is rendered larger than that between the boss 89 and fourth positioning portion 91. In other words, the cartridge 2 is more precisely positioned relative to the apparatus main assembly 100A, on the side from which it receives driving force from the apparatus main assembly 100A.

In this embodiment, the third positioning portion 90 is literally U-shaped in cross section (FIG. 7). The fourth positioning portion 91 is roughly U-shaped in cross section, that is, U-shaped, but not exactly (FIG. 6); the bottom portion of the fourth positioning portion 91, which corresponds to the bottom portion of letter U, has edges which are right-angled in cross section. Both the third and fourth positioning portions 90 and 91 are positioned so that their openings face an incoming cartridge 2.

As the cartridge 2 receives rotational driving force from the apparatus main assembly 100A, such moment that acts in the direction to rotate the cartridge 2 about the axial lines of the bearings 84 and 85, which coincide with the axial line of the photosensitive drum 21, is generated. However, the above described third and fourth positioning portions 90 and 91 (regulating portions) prevent this moment from rotating the cartridge 2. More specifically, as the cartridge 2 begins to be rotated by the above described moment, the boss 88 comes into contact with the top surface of the bottom portion 90*a* of the third positioning portion 90, and the boss 89 comes into contact with the top surface 91*a* of the bottom portion of the fourth positioning portion 91. As a result, the drum unit 25 is prevented from moving (rotating) upward. More precisely, all that is necessary for the drum unit 25 to be prevented from moving upward is that either the boss 88 or 89 comes into, and remains in contact, with the above described top surface 90*a* or 91*a* of the bottom portion of the boss 88 or 89, respectively.

As the door 15 is closed, the closing movement of the door 15 causes the levers (unshown) of the bearings 84 and 85 to be pressed. As a result, the bearings 84 and 85 are correctly positioned relative to the apparatus main assembly 100A, and kept in the positions into which they are moved. Therefore, even if the cartridge 2 receives driving force, the bearings 84 and 85 do not change in position.

[Operation to Separate Development Roller from Photosensitive Drum]

Figure 8:
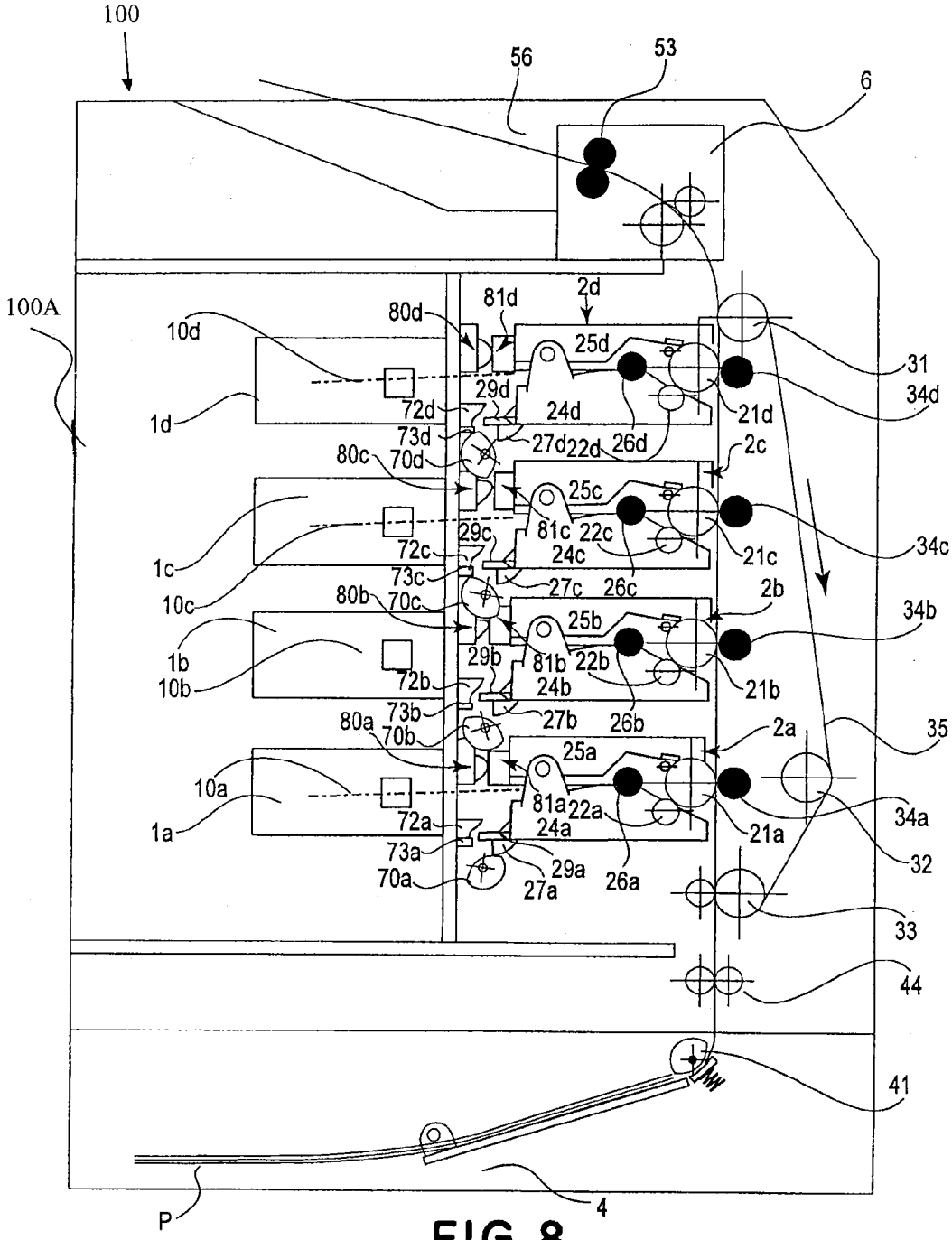
FIG. 8 is a sectional view of an image forming apparatus in the first embodiment of the present invention, showing the general structure thereof.

Referring to FIGS. 1 and 8, the rotation of the development unit 24 is caused by a cam 70*a*, 70*b*, 70*c*, and 70*d*, which is disposed in the apparatus main assembly 100A. The cam 70*a*, 70*b*, 70*c*, and 70*d* lifts a protrusion 27*a*, 27*b*, 27*c*, and 27*d*, as a force catching portion, with which the bottom surface of the development unit 24 is provided. The lifting of the protrusion 27 causes the development unit 24 to rotate upward about a fulcrum 26 (26*a*, 26*b*, 26*c*, and 26*d*). In other words, in the final stage of the mounting of the cartridge 2 into the apparatus main assembly 100A, the protrusion 27 is subjected to the reaction force which is generated as the development unit 24 is pivotally moved, against the pressure generated by the tension springs 28, from the contact position in which the development unit 24 keeps the photosensitive drum 21 and development roller 22 in contact with each other, to the separation position in which the development unit 24 keeps the photosensitive drum 21 and development roller 22 separated from each other. As the development unit 24 is pivotally moved upward, the development roller 22 is separated from the photosensitive drum 21; in other words, the development unit 24 is moved into the separation position (FIG. 3), putting thereby the cartridge 2 on standby.

When the development unit 24 is pivotally moved in the direction to cause the development roller 22 to separate from the photosensitive drum 21, the development unit 24 is moved against the tensional force of the tension springs 28 (FIGS. 3 and 4), which will be described later. Further, in this case, the upward movement of the drum unit 25 is checked by both the contact between the boss 88 and the top surface 90*a* of the bottom portion of the third positioning portion 90, and/or the contact between the boss 89 and the top surface 91*a* of the bottom portion of the fourth positioning portion 91. In other words, the bosses 88 and 89, as regulating portions, prevent the drum unit 25 from being moved by the force which the abovementioned protrusion 27 receives from the apparatus main assembly 100A.

On the other hand, as the cam 70*a*, 70*b*, 70*c*, and 70*d* is rotated from the position in which it lifts the protrusion 27, to the position in which it does not contact the protrusion 27, the development unit 24 rotates downward about the fulcrum 26. As a result, the development roller 22 comes into contact with the photosensitive drum 21 across their entire ranges in terms of their lengthwise direction. In other words, the development unit 24 is moved into the contact position (FIG. 2); the cartridge 2 is readied for image formation. When the development unit 24 is pivotally moved in the direction to cause the development roller 22 to come into contact with the photosensitive drum 21, the development unit 24 is moved by its own weight and the tensional force of the tension springs 28 (FIGS. 3 and 4). After the contact between the photosensitive drum 21 and development roller 22, the tensional force from the tension springs 28 functions to keep the development roller 22 in contact with the photosensitive drum 21.

As the cartridge 2 is inserted into the apparatus main assembly 100A, the protrusion 27 rides onto the cam 70*a*, 70*b*, 70*c*, and 70*d*. As a result, the development unit 24 is placed in the separation position (FIG. 3); the cartridge 2 is put on standby. The cartridge 2 is structured so that when the cartridge 2 is in the apparatus main assembly 100A, the protrusion 27 (force catching portion) protrudes downward. In terms of the direction perpendicular to the direction in which the cartridge 2 is inserted into the apparatus main assembly 100A, the protrusion 27 is located on roughly the center of the cartridge 2. In terms of the direction in which the cartridge 2 is inserted into the apparatus main assembly, the protrusion 27 is located on the front side of the cartridge 2.

The cam 70*a*, 70*b*, 70*c*, and 70*d* is controlled by a mechanical power source (unshown) and a solenoid switch (unshown) with which the apparatus main assembly 100A is provided, so that each time the cam 70*a*, 70*b*, 70*c*, and 70*d* is driven, it rotates half a turn. Further, the cam 70*a*, 70*b*, 70*c*, and 70*d* is shaped so that it lifts the protrusion 27 when its rotational phase is 180°, assuming that when the rotational phase of the cam 70*a*, 70*b*, 70*c*, and 70*d* is 0°, the cam 70*a*, 70*b*, 70*c*, and 70*d* is not in contact with the protrusion 27 (cam 70*a*, 70*b*, 70*c*, and 70*d* is in the state shown in FIG. 8). Thus, for every half a turn of the cam 70*a*, 70*b*, 70*c*, and 70*d*, the development unit 24 is alternately placed in the contact position (in which it is ready for image formation), and the standby position (separation position). Further, in the apparatus main assembly 100A, a sensor (photo-interrupter) 73*a*, 73*b*, 73*c*, and 73*d* (FIGS. 1 and 9) for detecting the state (rotational phase) of the cam 70*a*, 70*b*, 70*c*, 70*d* is disposed.

[Separating Member]

Next, the structural arrangement for attaching the separating members 71*a*, and 71*b* to the cartridge 2 will be described. The separating member 71*a* and 71*b* are to be attached when the cartridge 2 is out of the apparatus main assembly 100A, for example, immediately before the cartridge 2 is shipped out of a cartridge factory. Referring to FIG. 4, the development unit 24 is provided with a pair of separating member mounts 24*e* and 24*f*, which are on the lengthwise end surfaces of the development unit 24, one for one. Further, one of the lengthwise end surfaces of the drum unit 25 is provided with a hole 83*a*, and the other lengthwise end surface is provided with a hole 83*b*.

Figure 12:
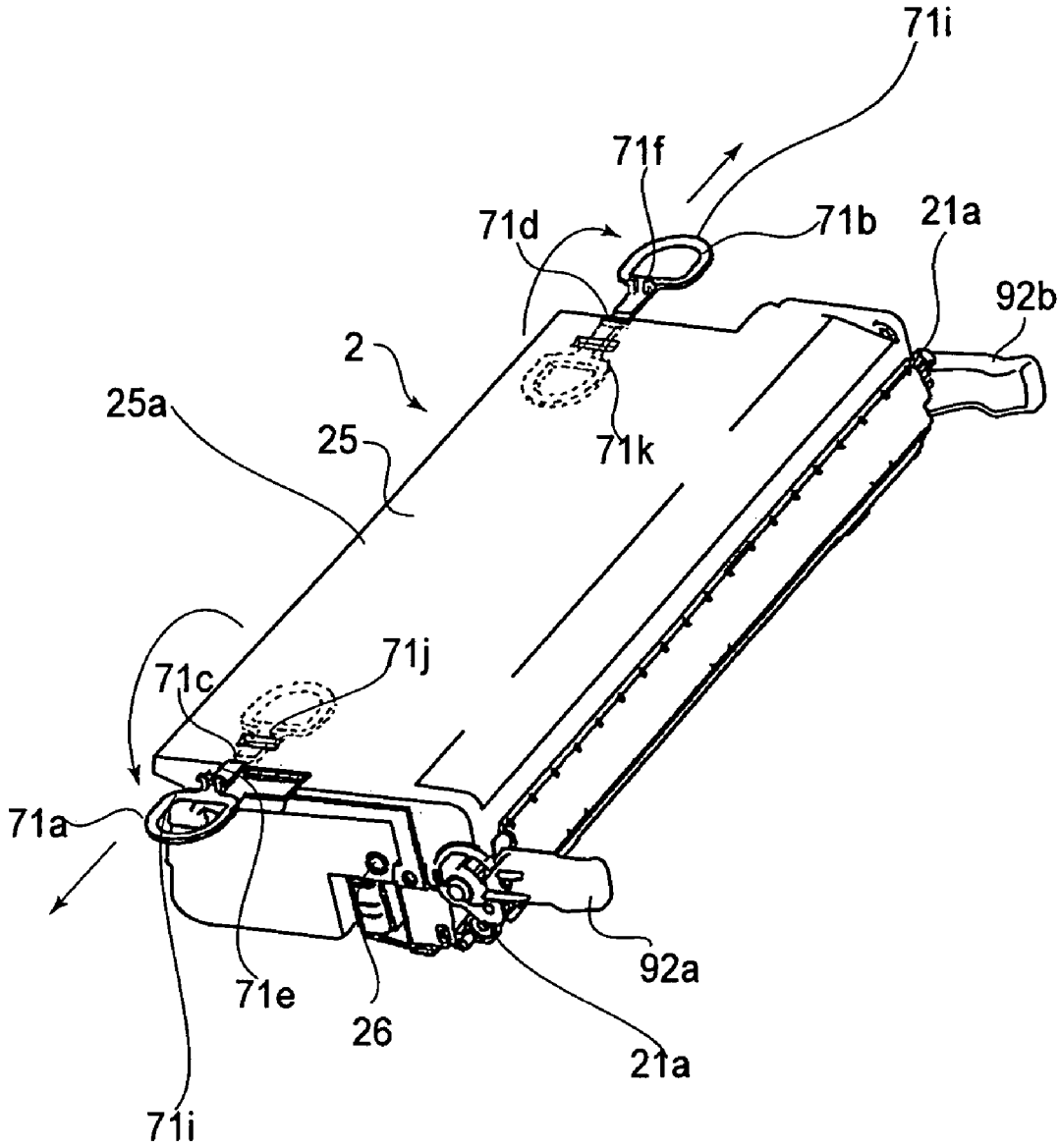
FIG. 12 is a perspective view of the process cartridge fitted with the separating members, in the first embodiment of the present invention, showing how to attach the separating members to the process cartridge.

A separating member 71*a*, or one of a pair of separating members for the cartridge 2, is provided with an anchor portion for attaching the separating member 71*a* to the cartridge 2, and a separating member 71*b*, or the other of the pair of separating members, is provided with an anchor portion 71*h* for attaching the separating member 71*b* to the cartridge 2. As for the procedure for attaching the separating member 71*a*, that is, one of the pair of separating members, to one of the lengthwise ends of the cartridge 2, first, the anchor portion of the separating member 71*a* is to be put through the hole 83*a* of the drum unit 25, and then, through the hole of the separating member mount 24*e* (FIG. 4). Then, the portion of the separating member 71*a*, which extends from the development unit 24 and the drum unit 25 (drum unit 25 in the drawing), is to be bent at a hinge portion 71*c* so that a tab portion 71*i* lies flat on the top surface 25*a* of the drum unit 25. Then, the tab portion 71*i* is to be separably fixed to the top surface 25*a*. That is, a protrusion 71*e*, with which the separating member 71*a* is provided, is fitted in a recess 71*j* (by snap-fitting or the like), with which the top surface 25*a* is provided (FIG. 12).

As for the procedure for attaching the separating member 71*b*, or the other separating member, to the other lengthwise end of the cartridge 2, first, an anchor portion 71*h* of the separating member 71*b* is to be put through the hole 83*b* of the drum unit 25, and then, through the hole of the separating member mount 24*f* (FIG. 4). Then, the portion of the separating member 71*b*, which extends from the development unit 24 and the drum unit 25 (drum unit 25 in the drawing), is to be bent at a hinge portion 71*d* so that a tab portion 71*i* lies flat on the top surface 25*a* of the drum unit 25. Then, the tab portion 71*i* is to be separably attached to the top surface 25*a*. That is, a protrusion 71*f*, with which the separating member 71*b* is provided, is fitted into a recess 71*k* (by snap-fitting or the like), with which the top surface 25*a* is provided.

With the employment of the above described procedures, the separating members 71 (71*a* and 71*b*) are removably attachable to the cartridge 2. As the separating members 71 are put through the holes of the separating member mount 24*e* and 24*f*, the mounts 24*e* and 24*f* are lifted by the slanted surfaces of the anchor portion of the separating member 71*a* and the anchor portion 71*h* of the separating member 71*b*, causing thereby the development unit 24 to rotate about the fulcrum 26. As the result, the development roller 22 is separated from the photosensitive drum 21. In other words, the development unit 24 is placed in the separation position.

In this embodiment, the separating members 71 (71*a* and 71*b*) are removably attached to the drum unit 25 (holes 83*a* and 83*b*) and development unit 24 (holes of separating member mounts 24*e* and 24*f*), as described above, so that the tab portions 71*i*, which extend from the drum unit 25 and development unit 24, lie flat on the top surface 25*a* of the drum unit 25, with their end portions fitted in the recesses of the top surface 25*a*.

As described above, in this embodiment, the cartridge 2 is removably mountable in the apparatus main assembly 100A with the separating members 71 remaining attached to the cartridge 2, because the above described structural arrangement prevents the tab portions 71*i* from coming in contact with the interior of the apparatus main assembly 100A.

Also in this embodiment, the separating members 71 are attached to the cartridge 2 so that the tab portions 71*i* conform to the top surface 25*a* of the drum unit 25. However, it is not mandatory to make the tab portions 71*i* to conform to the top surface 25*a*. For example, the tab portions 71*i* may be made to conform to one of the external surfaces of the development unit 24, or both the surfaces of the development unit 24 and the drum unit 25. In other words, what is essential here is that the separating members 71 are attached to the development unit 24 and the drum unit 25 so that the portion of each separating member 71, which extends from the development unit 24 and the drum unit 25, conforms to one of the surfaces of the drum unit 25 or development unit 24, with the tab portion 71*i* separably held to the drum unit 25 or development unit 24. With the employment of the above described structural arrangement, it does not occur that the separating members 71 left attached to the cartridge 2 interfere with the mounting of the cartridge 2 into the apparatus main assembly 100A.

Next, referring to FIG. 12, the procedure for removing the separating members 71 from the cartridge 2 will be described. Each separating member 71 is designed so that it can be easily pulled out of the cartridge 2 after the tab portion 71*i* is folded back about the hinge portion 71*c*. The separating member 71 is provided with the tab portion 71*i*, which is for making it easier for an operator to pull the separating member 71 out of the drum unit 25. Thus, when it is necessary to remove the separating member 71 from the drum unit 25, the operator has only to pull the separating member 71 by grasping the tab portion 71*i*.

Incidentally, the portion of the separating member 71, which extends from the development unit 24 and the drum unit 25, may be formed of a flexible material (for example, a piece of string) so that when it is necessary to remove the separating member 71 from the development unit 24 and the drum unit 25, the operator can remove the separating member 71 by pulling the flexible member, for example, the piece of string. With the employment of this design, it does not occur that the separating members 71 interfere with the mounting of the cartridge 2 into the apparatus main assembly 100A; the strings do not interfere with the mounting. However, what is essential here is that the portion of the separating member 71, which extends from the development unit 24 and the drum unit 25, is made to conform to the exterior of the unit onto which the portion is laid. As long as this requirement is satisfied, it does not occur that the separating member 71 interferes with the mounting of the cartridge 2.

As described above, the separating members 71 keep the development unit 24 in the separation position against the resiliency of the tension springs 28. Further, the separating members 71 are removably attached to the cartridge 2 in such a manner that even if the separating members 71 remain attached to the cartridge 2 when the cartridge 2 is mounted into the apparatus main assembly 100A, the separating members 71 do not interfere with the mounting of the cartridge 2 into the apparatus main assembly 100A. More specifically, in order to prevent the separating members 71 on the cartridge 2 from interfering with mounting of the cartridge 2 into the apparatus main assembly 100A, each separating member 71 is attached to the cartridge 2 in such a manner that the portion of the separating member 71, which extends from the development unit 24 and the drum unit 25, conforms to the exterior of the development unit 24 or the drum unit 25.

The employment of the above described structural arrangement ensures that the separating members 71 on the cartridge 2 do not interfere with the mounting of the cartridge 2 into the apparatus main assembly 100A. In this embodiment, therefore, the cartridge 2 can be mounted into the apparatus main assembly 100A with the separating members 71 remaining attached to the cartridge 2. Therefore, the image forming apparatus 100 can be transported from the factory therefor to a user, with the cartridge 2 or cartridges 2 mounted in the apparatus main assembly 10A. Therefore, this embodiment can improve the image forming apparatus in terms of the efficiency with which it is transportable, can reduce the amount of the packaging material for the image forming apparatus, and can simplify the procedure which must be followed by an operator to set up the image forming apparatus.

Incidentally, protective members may be inserted, if appropriate, between the adjacent two components among the various components of the cartridge 2 and apparatus main assembly 100A, which might possibly be damaged while the image forming apparatus is transported with the cartridges 2 mounted in the apparatus main assembly 100A.

Figure 10:
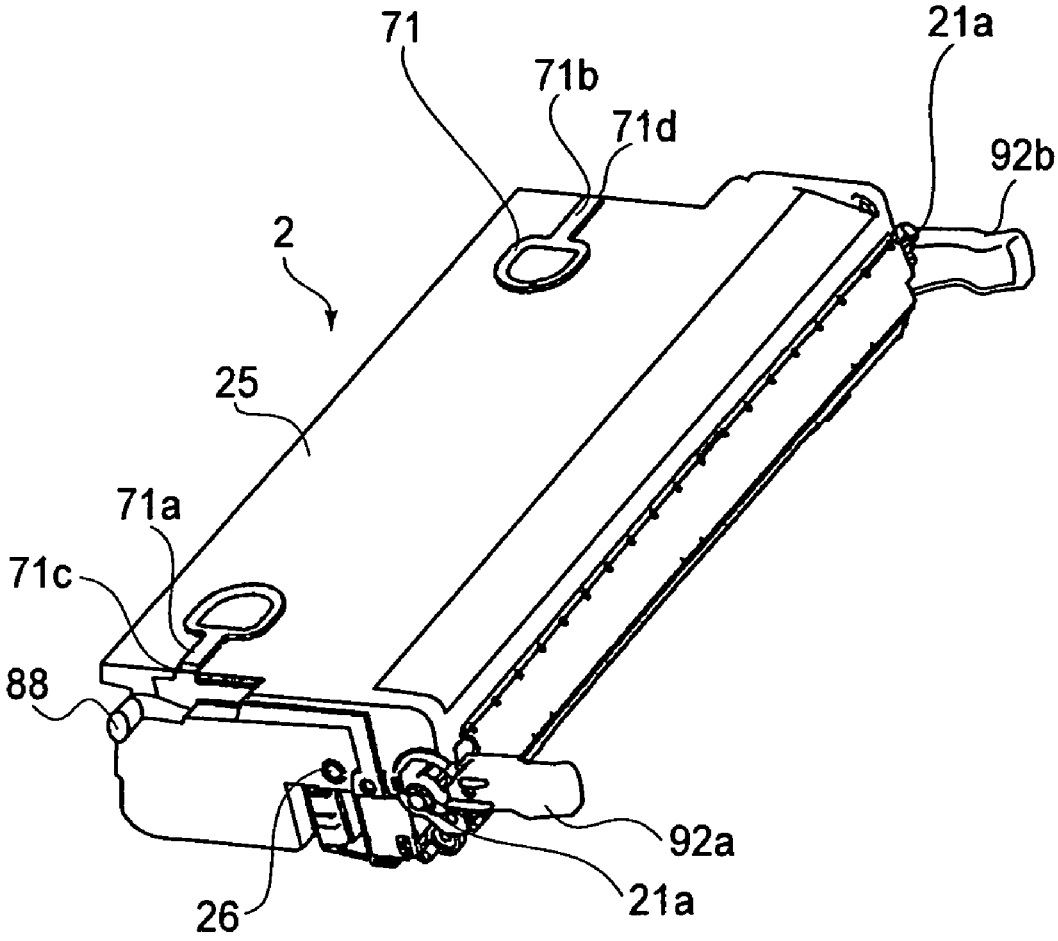
FIG. 10 is a perspective view of the process cartridge fitted with separating members, in the first embodiment of the present invention, showing the manner in which the separating members are attached to the process cartridge.
Figure 11:
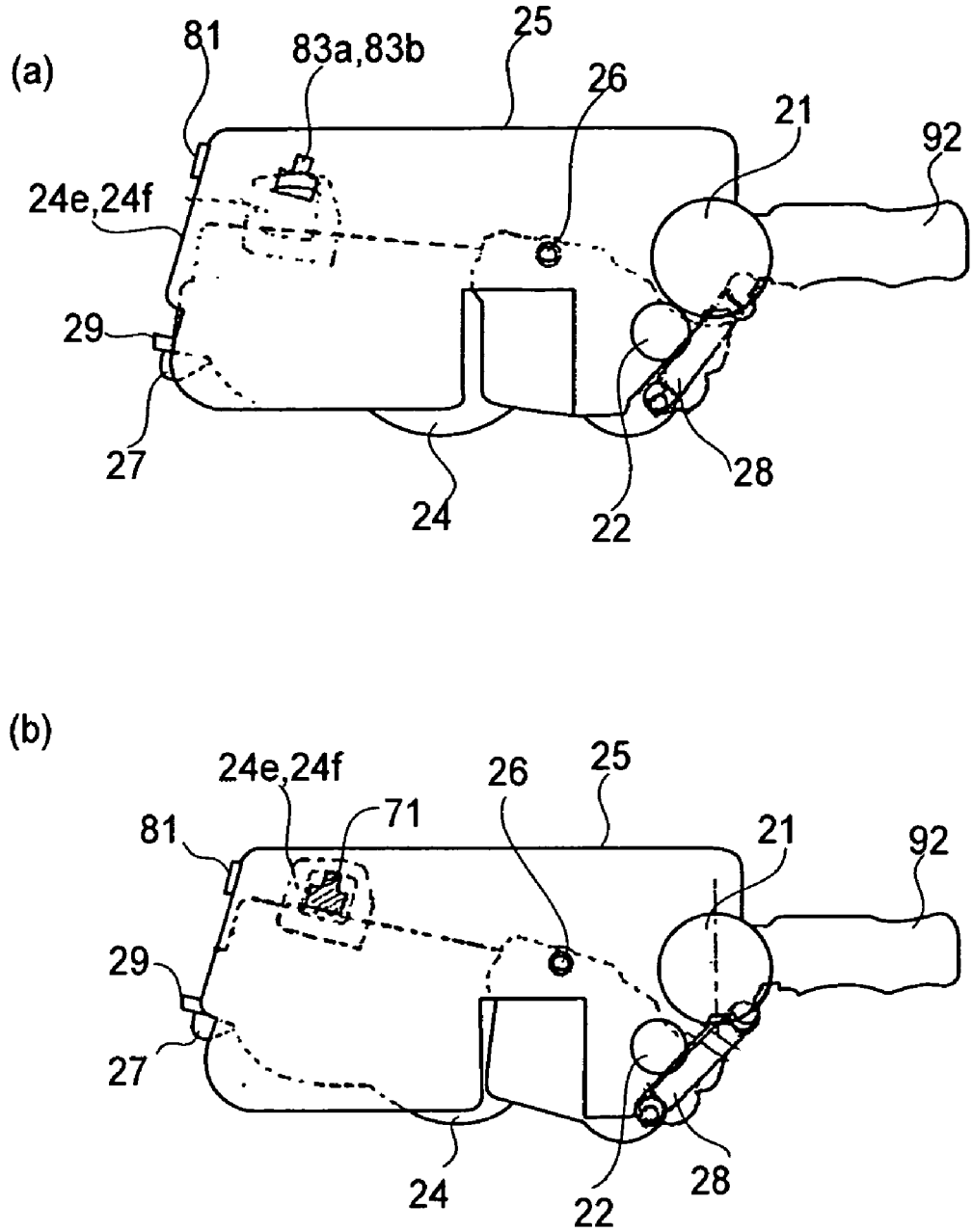
FIGS. 11(*a*) and 11(*b*) are side views of the process cartridge in the first embodiment of the present invention.

As described above, in this embodiment, when the cartridge 2 is shipped out of the factory therefor, the development unit 24 is held in the separation position (FIGS. 10 and 11), in which the development unit 24 keeps the development roller 22 separated from the photosensitive drum 21 (FIG. 11(*b*)); the image forming apparatus 100 is shipped from the factory therefor, with the cartridge 2, or cartridges 2, mounted in the apparatus main assembly 10A. Therefore, between when the image forming apparatus 100 is shipped out of the factory, and when the image forming apparatus 100 reaches a user, the development roller 22 and photosensitive drum 21 do not come into contact with each other. Therefore, it is possible to prevent the problem that while the image forming apparatus 100 is transported with the cartridge 2, or cartridges 2, mounted in the apparatus main assembly 100A, the photosensitive drum 21 and development roller 22 are damaged by the vibrations which occur during the transportation, the impacts resulting from a fall, and/or the like causes.

After the reception of the image forming apparatus 100 by a user, the user is to remove the cartridge 2 (cartridges 2) from the apparatus main assembly 100A. At this point in time, the separating members 71 are remaining attached to the cartridge 2. Thus, the user is to remove the separating members 71 from the cartridge 2. As the separating members 71 are removed from the cartridge 2, the development unit 24 rotates into the contact position (FIG. 11(*a*)). This rotation of the development unit 24 is caused by the tensional force coming from the resiliency of the tension springs 28 (FIGS. 3 and 4) as pressure applying members.

Further, each cartridge 2 in this embodiment is provided with a storage element 81 (storage element on cartridge side) (81*a*, 81*b*, 81*c*, and 81*d*). In the storage element 81, such information as the cumulative number of copies made with the use of the cartridge 2, the remaining amount of developer, etc., is stored. Such information as whether or not a given cartridge 2 has never been used (brand-new or not), the expected length of cartridge life, and the information stored in the storage element 81, are transmitted back and forth between the storage elements (80*a*, 80*b*, 80*c*, and 80*d*), with which the apparatus main assembly 100A is provided, and the storage elements 81, respectively.

In terms of the direction intersecting the abovementioned cartridge mounting direction, the storage element 81 is located at one end of the cartridge 2. In terms of the cartridge mounting direction, the storage element 81 is located at the leading end of the cartridge 2.

[Structure of Means for Detecting Separating Member 71]

Figure 9:
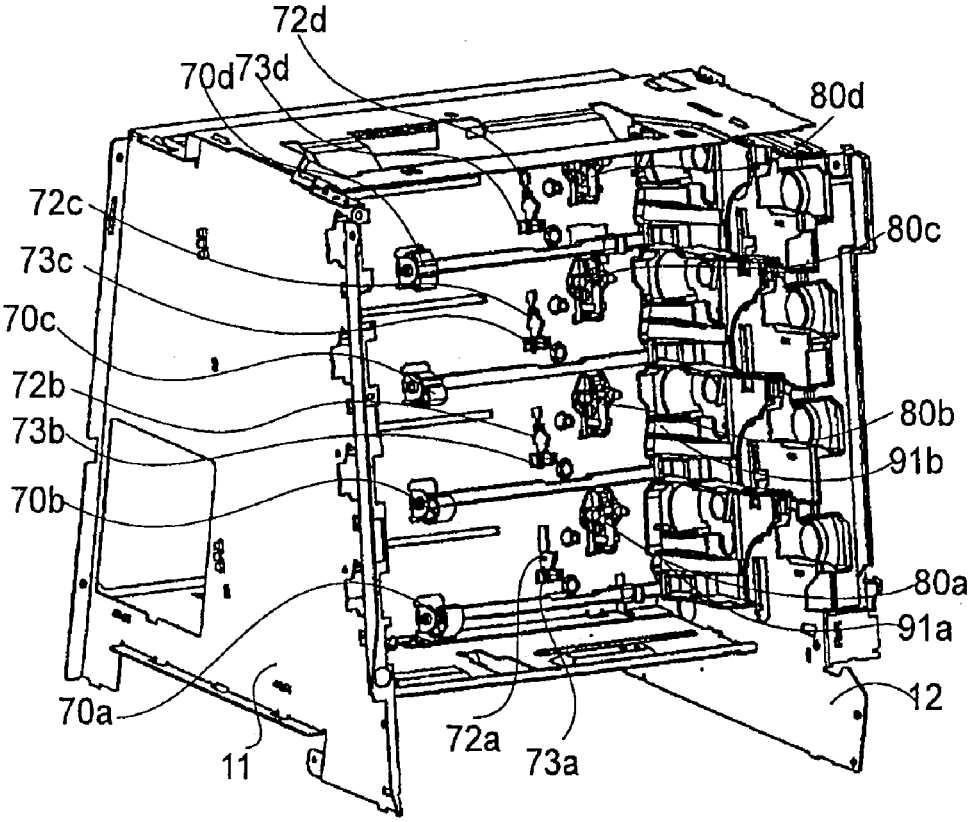
FIG. 9 is a perspective view of the image forming apparatus in the first embodiment of the present invention.

Shown in FIGS. 1 and 9 are the structure of a detection lever 72*a*, 72*b*, 72*c*, and 72*d* and the structure of a sensor 73*a*, 73*b*, 73*c*, and 73*d*. FIG. 9 is a perspective view of the frame of the apparatus main assembly 100A, the door of which, shown in FIG. 1, has been removed, as seen from the direction indicated by an arrow mark in FIG. 1.

Referring to FIGS. 1 and 9, the apparatus main assembly 100A is provided with a detection lever (separating member detecting means) 72 (72*a*, 72*b*, 72*c*, and 72*d*), and a sensor (separating member detecting means: photo-interrupters) 73 (73*a*, 73*b*, 73*c*, and 73*d*), which are disposed in the apparatus main assembly 100A. Each of the detection levers 72 (72*a*-72*d*) is enabled to slide in contact with a separating member detecting portion 29 (29*a*, 29*b*, 29*c*, and 29*d*) with which the development unit 24 (24*a*-24*d*) is provided. Each cartridge bay 100*a*, 100*b*, 100*c*, and 100*d* is provided with the detection lever 72 and sensor 73.

The detection lever 72 comes into contact with the separating member detecting portion 29 when the cartridge 2 is inserted into the cartridge bay (100*a*, 100*b*, 100*c*, and 100*d*), with the separating members 71 remaining attached to the cartridge 2 (with cartridge 2 remaining on standby). As a result, the detection lever 72 is slid into the position in which it does not shield the sensor 73 from the separating member detection light. By detecting that the sensor 73 is not shielded from the detection light, a controller 60 (FIG. 14) determines that the separating members 71 have not been removed. This process will be described later in detail.

If the separating members 71 have been removed, and the cam 70 (70*a*, 70*b*, 70*c*, and 70*d*) does not come into contact with the protrusion 27 (cartridge is ready for image formation) even if the cam 70 is rotated from the position in which the cam 70 keeps the cartridge 2 on standby, to the position in which the cam 70 allows the cartridge 2 to form an image, the detection lever 72 is not slid by the detecting portion 29. That is, whether or not the separating members 71 have been removed from the cartridge 2 is determined by the controller 60, and then, an image forming operation is carried out. As described above, the detecting portion 29 is a member for detecting whether or not the separating members 71 are still on the cartridge 2 in the apparatus main assembly 100A. The detecting portion 29 is located on the same end of the cartridge 2 as the storage element 81. Further, the detecting portion 29 is located at the leading (front) end of the cartridge 2 in terms of the cartridge mounting direction.

The sensor 73 is independent from the sensor for detecting the rotational phase of the cam 70. As the sensor 73, such a switch that can be turned on or off by the movement of the detection lever 72 may be employed.

As described above, if a cartridge 2, the development unit 24 of which is in the separation position, into which the attachment of the separating members 71 rotates the development unit 24, is mounted into the apparatus main assembly 100A, the detecting portion 29 causes the detection lever 72 to slide into the position in which the detection lever 72 shields the sensor 73 from the separating member detection light. In other words, the sensor 73 detects this movement of the detection lever 72, detecting thereby the presence or absence of the separating members 71. As described above, the detecting means for detecting the presence or absence of the separating members 71 has the detection lever 72 which is slidable by a part of the development unit 24, which comes into contact with the detection lever 72 when the development unit 24 is in the separation position, and the sensor 73, the state of which is affected by the position of the detection lever 72.

In this embodiment, each of the multiple cartridge bays 100*a*, 100*b*, 100*c* and 100*d* is provided with its own detection lever 72 and sensor 73. As long as one of the separating members 71 remains attached to the cartridge 2, the detection lever 72 is slid, and it is detected by the apparatus main assembly 100A (controller 60), through the process which will be described later, that an image forming operation is about to be started with at least one of the separating members 71 remaining attached to the cartridge 2.

(Sequence for Detecting Presence or Absence of Separating Member 71)

Figure 13:
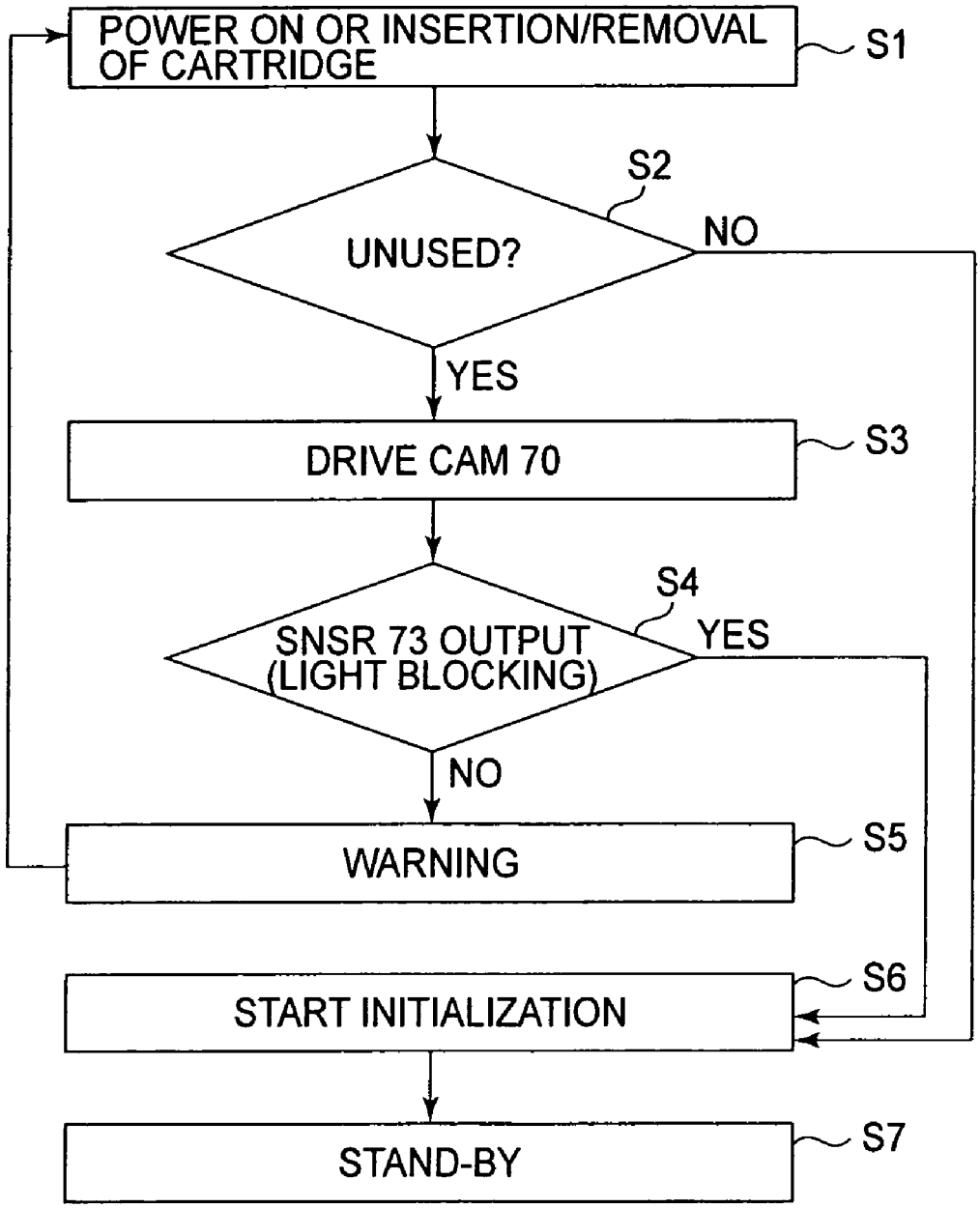
FIG. 13 is a flowchart of the operation for detecting the presence or absence of the separating members, in the first embodiment.

Next, the sequence for detecting the presence or absence of the separating member 71 will be described. That is, the sequence for detecting whether or not the cartridge 2 in the apparatus main assembly 100A still has the separating member(s) 71 will be described. FIG. 13 is a flowchart of the operation for detecting the presence or absence of the separating member(s) 71. As shown in FIG. 13, as the power source (FIG. 14) with which the image forming apparatus 100 is provided is turned on, or it is determined that the mounting of the cartridge(s) 2 has been completed (S1), it is determined whether or not the cartridge(s) 2 is brand-new (S2). This determination will be described later.

Incidentally, whether or not the cartridge 2 has just been mounted into, or removed from, the apparatus main assembly 100A is determined by detecting the opening or closing movement (except for those for dealing with paper jam or the like) of the door 15, which has to be opened to mount the cartridge 2.

That a cartridge 2 has never been used (cartridge is brand-new) means that the cartridge 2 has never been used for image formation. That a cartridge 2 has been used means that the cartridge 2 has been used for image formation.

As for the method for detecting whether or not the cartridge 2 has been used for image formation, the following are possible. For example, the information regarding a given cartridge 2 is stored in the abovementioned storage element 81. Thus, whether or not the cartridge 2 has been used is determined through the exchange of the information between the storage elements 80 and 81. It is also possible to employ a fuse. In this case, a cartridge 2 is provided with such a fuse that burns out the first time the cartridge 2 is used for image formation.

If it is determined that the cartridge 2 has never been used in (S2), only the cam 70 is rotated (to switch state of cartridge 2 from on standby to ready for image formation) (S3), and the state of the sensor 73 is checked (it is determined whether or not detection light is blocked) (S4). If the detection light is not blocked, the controller 60 warns an operator through a warning device 1 or the like that the separating members 71 must be removed (S5). In this case, the image forming apparatus 100 does not carry out the initialization process (S5). In other words, the image forming apparatus does not start an image forming operation.

As described above, each cartridge 2 is provided with the storage element 81. When a given cartridge 2 is brand-new, its storage element 81 is holding the information that the cartridge 2 is brand-new. If it is recognized, based on the information in the storage element 81, that the cartridge 2 has never been used, the separating member detecting process is carried out by the combination of the detection lever 72 and sensor 73, as the detecting means. If it is not recognized that the cartridge 2 has never been used, the detecting process is not carried out by the lever 72 and sensor 73. FIG. 14 is a block diagram of the image forming apparatus 100 in this embodiment.

As described above, a driving force is given to the cartridge 2 by the motors 61 and 62 with which the apparatus main assembly 100A is provided. To the cam 70, driving force is given by a motor 63. Whether or not the detection lever 72 is moved is determined by the state of the development unit 24 as described above, and the movement of the detection lever 72 is detected by the sensor 73. The results of the detection by the sensor 73 are received by the controller 60. If the results of the detection indicate that the separating members 71 are remaining attached to the cartridge 2, the controller 60 informs the operator of the presence of the separating members 71 through the warning device 1. In other words, the controller 60 issues a warning if the sensor 73 detects that the development unit 24 is in the separation position. The contents of the message issued through the warning device 1 or the like are optional. The warning issued through the warning device 1 may be in the form of sound, flickering light, or the like. Further, the warning message may be displayed on the monitor of a personal computer.

Figure 15:
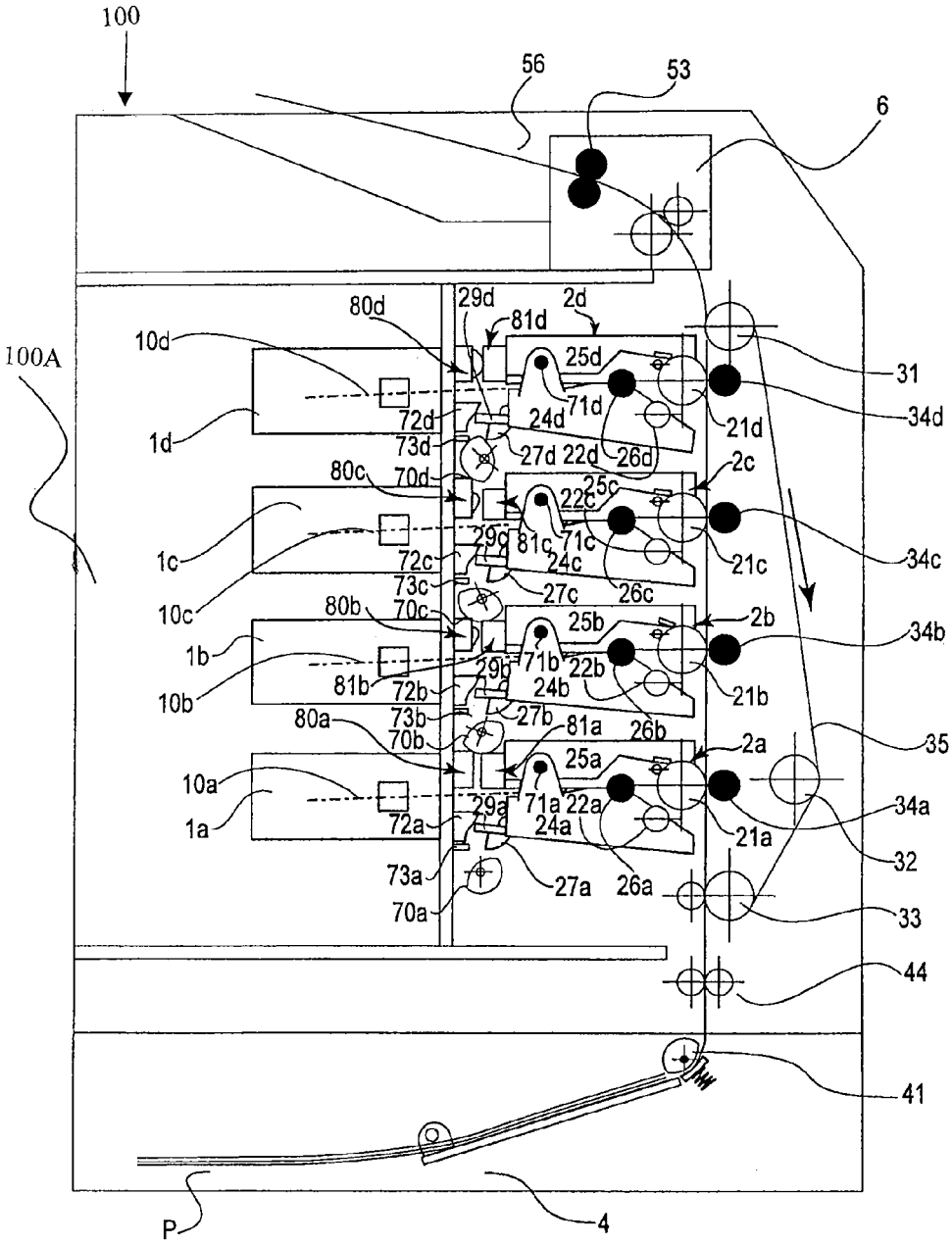
FIG. 15 is a sectional view of the image forming apparatus (which is on standby), in the first embodiment of the present invention, in which a cam has been rotated after the mounting of the process cartridge into an apparatus main assembly of the image forming apparatus.

Referring to FIG. 15, when the separating members 71 remain attached to the cartridge 2, the development unit 24 does not rotate even if the cam 70 is rotated from the position which corresponds to the standby state of the cartridge 2 to the position which corresponds to the image formation-ready state of the cartridge 2. Therefore, the development unit 24 remains in the separation position (cartridge 2 remains on standby), allowing the detection light to reach the sensor 73. Thus, as the controller 60 detects that the sensor 73 is not shielded from the detection light, it determines that the separating members 71 are remaining attached to the cartridge 2. Further, while the cartridge 2 is in the apparatus main assembly 100A, the cam 70 is kept separated from the protrusion 27, and therefore, it does not occur that the cam 70 and protrusion 27 are damaged while the image forming apparatus 100 is transported with the cartridge(s) 2 mounted in the apparatus main assembly 100A.

On the other hand, if it is determined that the cartridge 2 has been used (S2), or the sensor 73 is shielded from the detection light (S4), it is determined that the separating members 71 have been removed. Then, the image forming apparatus starts the initialization process (S6), putting thereby the cartridge 2 on standby for image formation (S7). In other words, it starts an image forming operation.

As described above, as the controller 60 detects the presence of the separating members 71, it issues a warning, prompting thereby an operator to remove the detected separating members 71 in order to prevent the malfunctions of the apparatus and/or damage to the apparatus which occur when an image forming operation is carried out while the separating members 71 remain attached to the cartridge 2. Incidentally, the above described process is carried out only when the cartridge 2 in the apparatus main assembly 100A is such a cartridge that has never been used. Therefore, time is not wasted for unnecessarily carrying out the process for detecting the separating members 71, preventing thereby the starting of the image forming process from being delayed by the process unnecessarily carried out for detecting the separating members 71.

Figure 16:
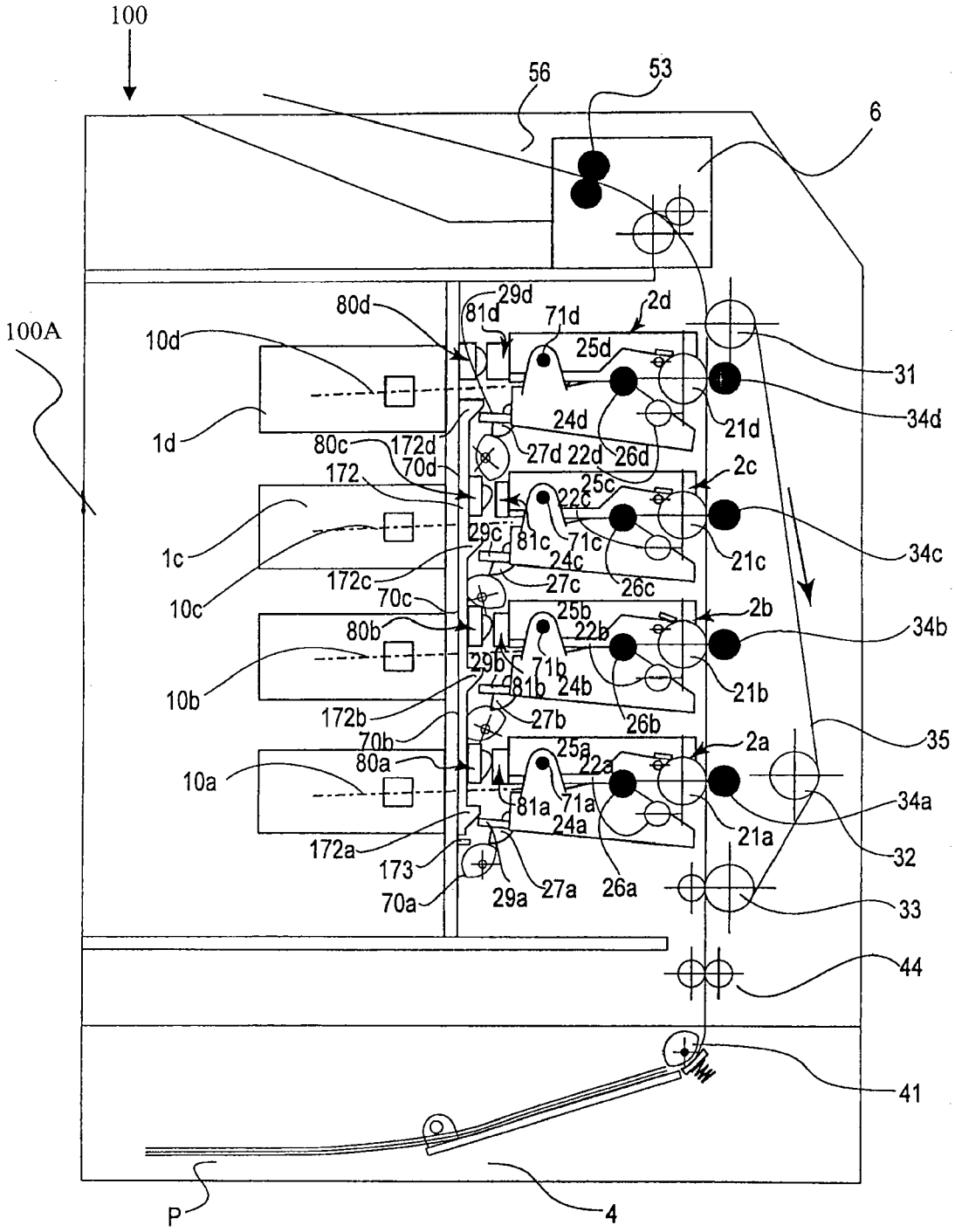
FIG. 16 is a sectional view of a modification of the image forming apparatus in the first embodiment of the present invention.

In the above, the structural arrangement in which the detection lever 72 is provided for each of the multiple cartridges 2 was described. However, the application of the present invention is not limited to the above described structural arrangement. For example, the present invention is also applicable to such a structural arrangement, shown in FIG. 16, that a single detection lever 172 and a single sensor 173 are employed to detect the presence or absence of all the separating members 71 (71*a*, 71*b*, 71*c*, and 71*d*) of the multiple cartridges 2 (2*a*, 2*b*, 2*c*, and 2*d*).

More specifically, in the case of such a structural arrangement, the detection lever 172 is provided with multiple protrusions 172*a*-172*d*, which match in position the multiple cartridges 2, one for one. Thus, any of the cartridges 2 is mounted into the apparatus main assembly 100A with the separating members 71 (71*a*, 71*b*, 71*c*, 71*d*) remaining attached to the cartridge 2, the corresponding protrusion (172*a*, 172*b*, 172*c*, and 172*d*) of the detection lever 172 is pushed up by the protrusion 27 (27*a*, 27*b*, 27*c*, and 27*d*) of the cartridge 2, causing thereby the detection lever 172 to slide into the position in which the detection lever 172 shields the sensor 173 from the detection light.

The employment of such a structural arrangement makes it possible to detect the presence or absence of all the separating members 71 of the multiple cartridges 2 with the use of only a single combination of the detection lever 172 and sensor 173. Therefore, it can reduce the separating member detecting means in component count, and therefore, it can contribute to the reduction in the cost of the image forming apparatus 100, and also, to the simplification of the image forming apparatus 100. Further, after the sliding of the detection lever 172 (into position in which it shields sensor 173 from detection light), it is detected, with the utilization of, for example, the storage elements 80 and 81, which cartridges 2 have never been used; it is possible to specify the cartridge bays of the apparatus main assembly 100A, which contain a cartridge 2, to which the separating members 71 are remaining attached (unused cartridge 2). In this embodiment, except for the periods in which an image is actually formed, the development unit 24 remains in the above-mentioned separation position. Therefore, the photosensitive drum 21 and development roller 22 are prevented from being unnecessarily rotated in contact with each other. Therefore, this embodiment can minimize the amount by which the photosensitive drum 21 and development roller 22 are frictionally worn by being rotated in contact with each other.

Also in this embodiment, the separating members 71 are used to keep the development unit 24 in the separation position during the transportation of the image forming apparatus 100. Therefore, even if the image forming apparatus 100 is transported with the cartridge(s) 2 mounted in the apparatus main assembly 100A, the photosensitive drum 21 and development roller 22 are prevented from being damaged by the vibrations which occur during the transportation of the image forming apparatus 100, the impacts resulting from the falls which might occur during the transportation of the image forming apparatus 100, etc.

Incidentally, the application of the present invention is not limited to such an image forming apparatus as the above described one, which employs the conveyer belt 35. For example, the present invention is also applicable to an image forming apparatus which employs an intermediary transfer member or the like.

Embodiment 2

Next, the image forming apparatus in the second embodiment of the present invention will be described with reference to the appended drawings. The components, portions, etc., of the image forming apparatus in this embodiment, which are identical to those in the first embodiment, are given the same reference symbols as those given for the description of the first embodiment, and will not be described to avoid the repetition of the same descriptions.

In the case of the image forming apparatus in the first embodiment, the position of the development unit 24 while the separating members 71 remain attached to the cartridge 2 is the same as the position into which the development unit 24 is moved as the protrusion 27 is pushed up by the cam 70; they are the separation position (cartridge 2 is kept on standby). Further, the position into which the development unit 24 rotates as the separating members 71 are removed is the same as the position into which the development unit 24 is allowed to rotate by the rotation of the cam 70; these positions are the same position, which is the image formation position (cartridge is ready for image formation). In other words, the distance between the photosensitive drum 21 and development roller 22 while the separating members 71 remain attached to the cartridge 2 is the same as the distance between the photosensitive drum 21 and development roller 22 while the protrusion 27 is in the highest position into which it can be lifted by the cam 70.

Figure 17:
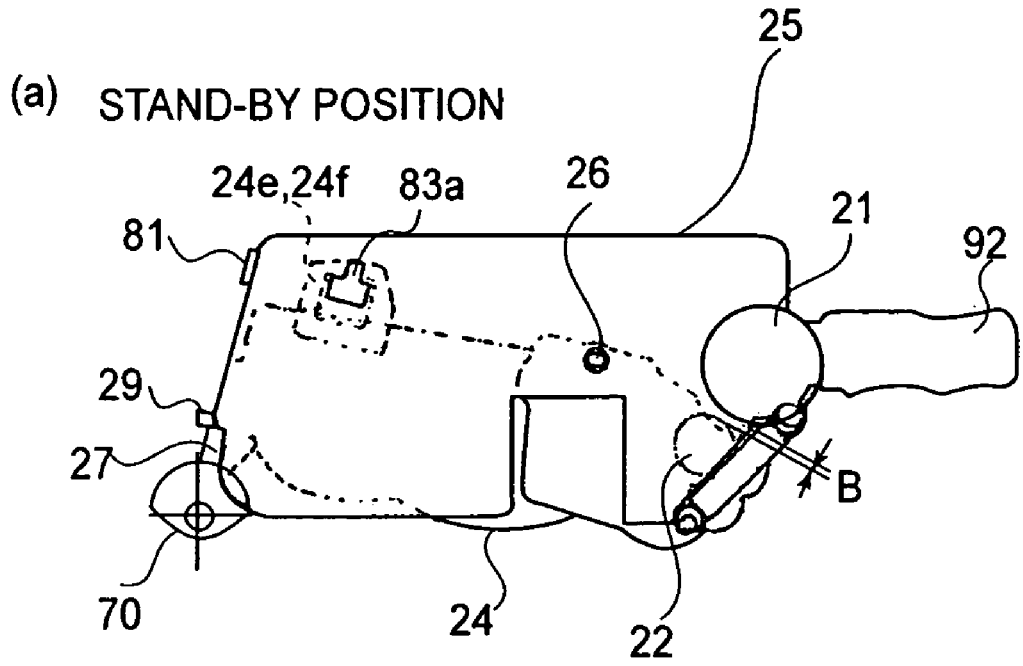
FIGS. 17(*a*) and 17(*b*) are side views of the process cartridge in the first embodiment of the present invention.
Figure 17:
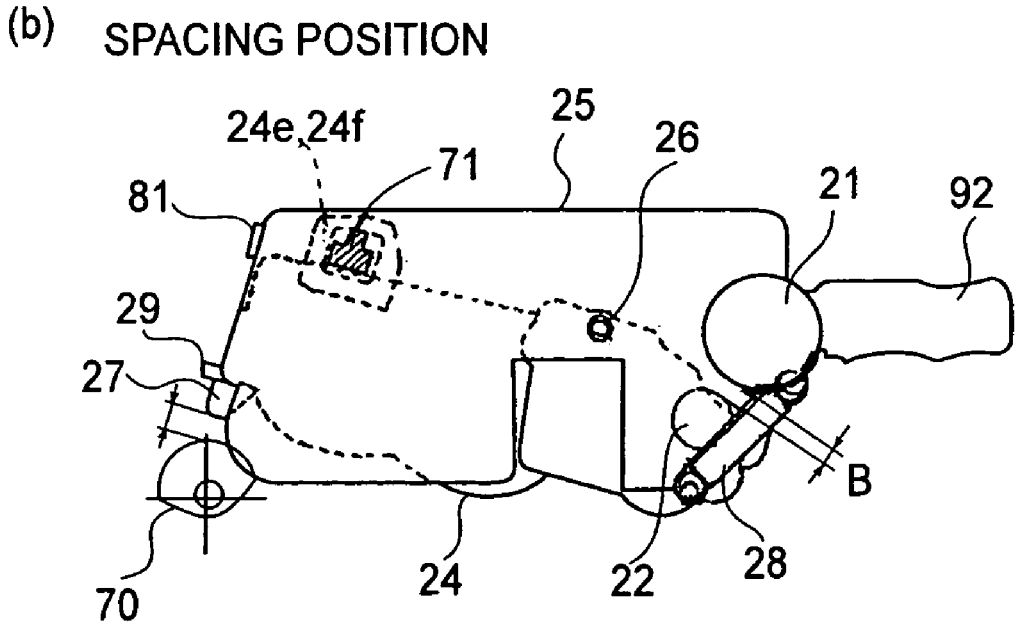

The image forming apparatus in this embodiment is made different from that in the first embodiment, in terms of the following aspect of the apparatus structure. That is, referring to FIGS. 17(*a*) and 17(*b*), the image forming apparatus in this embodiment is structured so that the angle by which the development unit 24 is rotated by the attachment of the separating members 71 (71*a*, 71*b*, 71*c*, and 71*d*) to the cartridge 2, that is, the insertion of separating members 71 between development unit 24 and drum unit 25, to be moved into the separation position (transportation position shown in FIG. 17(*b*)) is substantially greater than the angle by which the development unit 24 is rotated by pushing up the protrusion 27 by the cam 70 to move the development unit 24 (cartridge 2) into the separation position (in which development unit 24 is kept on standby, as shown in FIG. 17(*a*)). In other words, in this embodiment, as the separating members 71 are attached to the cartridge 2, the development unit 24 is rotated by a greater angle than when the protrusion 27 is pushed up by the cam 70.

With the employment of the above described structural arrangement, the distance by which the photosensitive drum 21 and development roller 22 are separated from each other by the attachment of the separating members 71 to the cartridge 2 is greater than the distance by which the photosensitive drum 21 and development roller 22 are separated from each other by the upward movement of the protrusion 27 caused by the cam 70. Incidentally, the angle by which the development unit 24 is rotated by the separating members 71 is determined by the size of the separating member mounts 24*e* and 24*f*. Thus, in the second embodiment, the size of the separating member mounts 24*e* and 24*f* is selected so that the angle by which the development unit 24 is rotated by the separating members 71 in the second embodiment is greater than the angle by which the development unit 24 is rotated by the separating members 71 in the first embodiment. In this embodiment, the position into which the development unit 24 is rotated by the upward movement of the protrusion 27 caused by the cam 70 will be referred to as the standby separation position (in which development unit 24 keeps cartridge 2 on standby), and the position into which the development unit 24 is rotated by the attachment of the separating members 71 will be referred to as the transportation separation position (in which development unit 24 is kept for transportation).

As will be evident from the above, in this embodiment, the attachment of the separating members 71 to the cartridge 2 causes the separating members 71 to rotate the development unit 24 into the transportation position, and retain the development unit 24 therein, as described above. However, the angle by which the development unit 24 is rotated by the separating members 71 in this embodiment is greater than the angle by which the development unit 24 is rotated by the separating members 71 in the first embodiment. Therefore, the distance by which the development roller 22 is separated from the photosensitive drum 21 by the attachment of the separating members 71 is greater than the distance by which the development roller 22 is separated from the photosensitive drum 21 by the attachment of the separating members 71 in the first embodiment. That is, the attachment of the separation members 71 in this embodiment to the cartridge 2 places the development unit 24 in the transportation separation position, which is greater in the distance between the development roller 22 and photosensitive drum 21 than the standby separation position, into which the development unit 24 is rotated by the rotation of the cam 70.

In this embodiment, the distance B between the peripheral surface of the photosensitive drum 21 and the peripheral surface of the development roller 22, (distance when development unit 24 is in standby separation position), shown in FIG. 17(*a*), was set to roughly 1.5 mm, whereas the distance B in FIG. 17(*b*) (distance when development unit 24 is in transportation separation position) was set to roughly 2.9 mm. Incidentally, in the first embodiment, both the distance B between the photosensitive drum 21 and development roller 22 when the development unit 24 is in the transportation separation position into which the development unit 24 is rotated by the separating members 71, and the distance B between the photosensitive drum 21 and development roller 22 when the development unit 24 is in the standby separation position into which the development unit 24 is rotated by the upward pushing of the protrusion 27 by the cam 70, were set to roughly 1.5 mm.

Also in this embodiment, it is ensured by placing the development unit 24 in the transportation separation position that the photosensitive drum 21 and development roller 22 are prevented from being damaged by the vibrations which occur while the image forming apparatus 100 is transported with the cartridge(s) 2 mounted in the apparatus main assembly 100A, the impacts resulting from the fall or the like of the image forming apparatus 100 which occur while the image forming apparatus 100 is transported with the cartridge(s) 2 mounted in the apparatus main assembly 100A, etc. In particular, in this embodiment, the photosensitive drum 21 and development roller 22 can be kept apart from each other by a greater distance by the separating members 71 than the distance by which the photosensitive drum 21 and development roller 22 can be kept separated by the separating members 71 in the first embodiment. Therefore, this embodiment is more effective to prevent the above described damages.

Next, referring to FIG. 18, the structural arrangement, in this embodiment, for detecting the presence or absence of the separating members 71 will be described.

Figure 18:
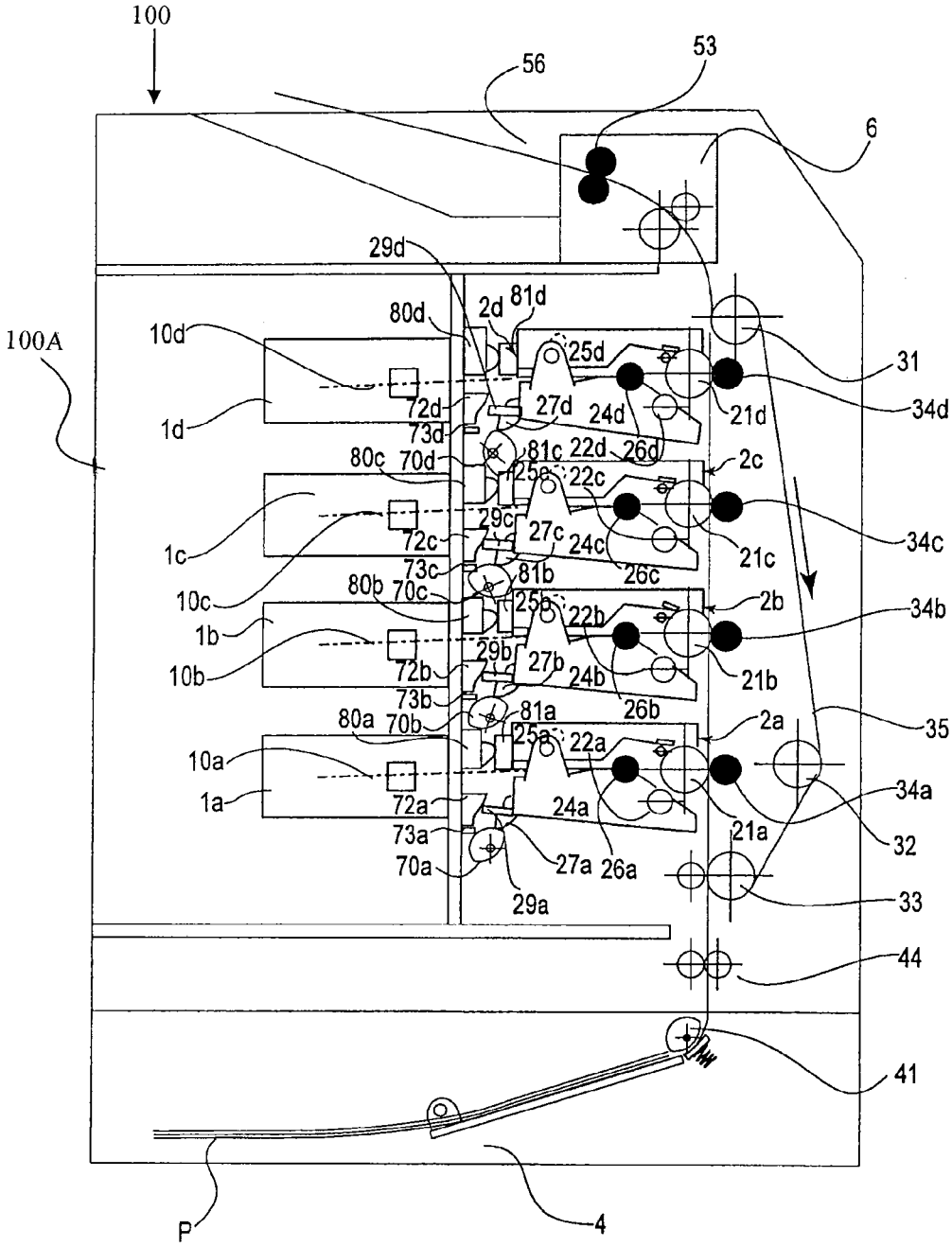
FIG. 18 is a sectional view of the image forming apparatus (which is in a second state) in the second embodiment of the present invention, showing the general structure thereof.
Figure 19:
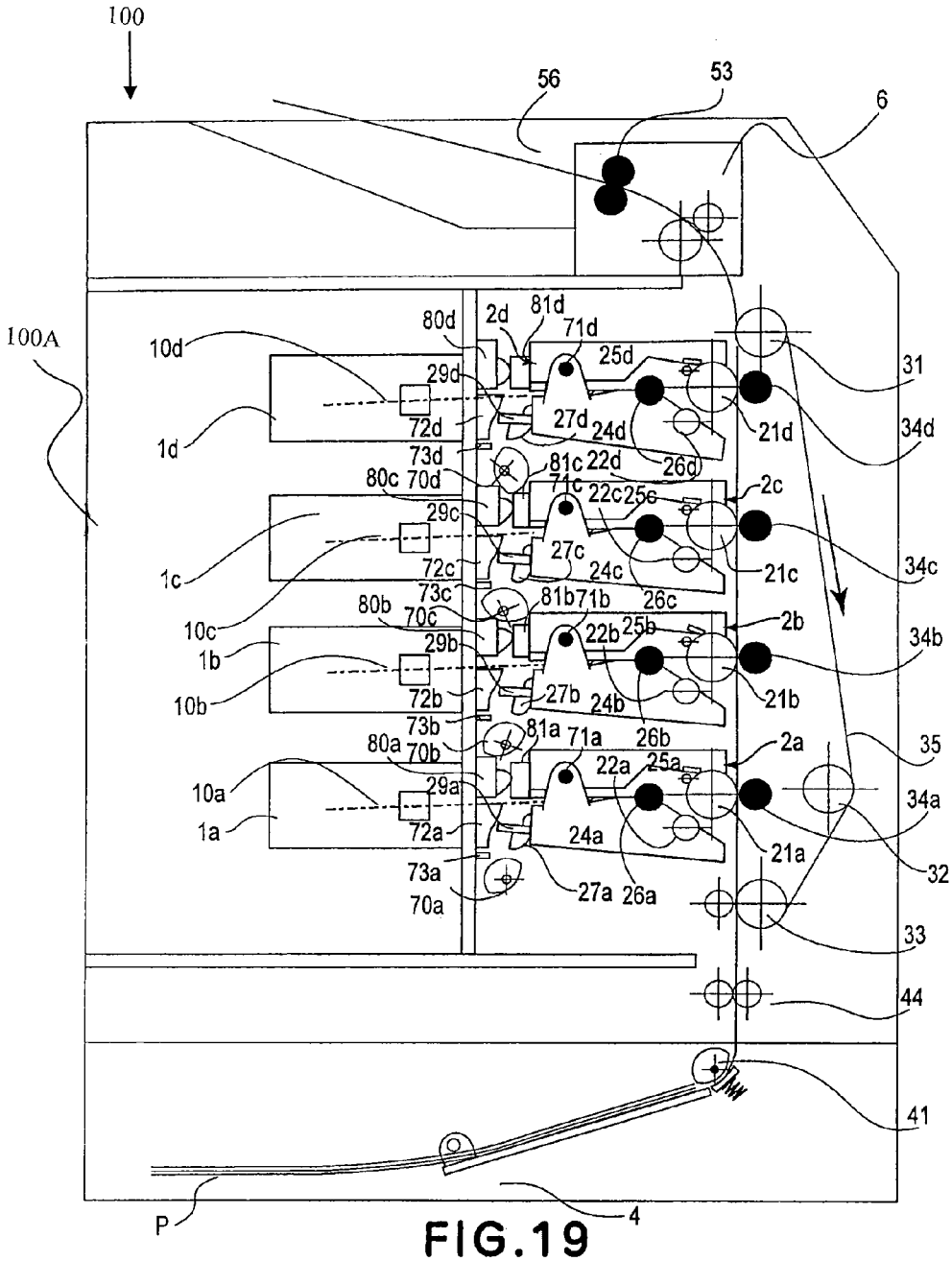
FIG. 19 is a sectional view of the image forming apparatus (which is in a third state) in the second embodiment of the present invention, showing the general structure thereof.

As depicted in FIG. 18, as a cam 70 (pressure applying means) rotates, it comes into contact with a protrusion 27 (force catching portion). As the cam 70 further rotates, it lifts the protrusion 27, causing thereby the development unit 24 to rotate into the standby separation position (in which development unit 24 is kept on standby). In this case, however, a detection lever 72 is not slid by a detection portion 29. On the other hand, as the separating members 71 are attached to the cartridge 2, the development unit 24 is rotated into the transportation separation position (in which development unit 24 is kept for transportation of the image forming apparatus with cartridge(s) mounted in apparatus main assembly). In this case, the detection lever 72 is slid by coming into contact with the detection portion 29 of the frame 83 of the development unit 24.

When the development unit 24 is in the standby separation position, the detection lever 72 shields the sensor 73 from the detection light, whereas when the development unit 24 is in the transportation separation position (in which development unit 24 is kept for transportation of the image forming apparatus with cartridge(s) mounted in apparatus main assembly), the detection lever 72 does not shield the sensor 73, because the detection lever 72 has been slid. More specifically, in this embodiment, the standby separation position and transportation separation position are different in the angle by which the development unit 24 is rotated to be placed into the two positions. That is, when the cartridge 2 is in the apparatus main assembly 100A, the detection portion 29 of the development unit 24 is higher in position when the development unit 24 is in the transportation separation position than it is in the standby separation position. Further, only when the development unit 24 is in the transportation separation position, the detection lever 72 is slid by the detection portion 29 into the position in which it does not shield the sensor 73, whereby the controller 60 detects that the detection lever 72 slid, in other words, the separating members 71 are remaining attached to the cartridge 2.

The detection lever 72 is provided for each of the multiple cartridges 2 in the apparatus main assembly 100A. That is, each of the cartridge bays 100*a*, 100*b*, 100*c*, and 100*d* is provided with its own detection lever 72. As long as the separating members 71 are remaining attached to any of the cartridges 2, the detection lever 72 is slid. As described above, as the cam 70 is rotated, it rotates from the position in which it does not contact the protrusion 27 into the range in which comes into contact with the protrusion 27 and presses the protrusion 27, whereby the development unit 24 is rotated from the contact position to the separation position.

The profile and positioning of the cam 70 are as follows: If a cartridge 2, the development unit 24 of which is in the contact position, is mounted into the cartridge bay 100, the cam 70 presses the protrusion 27 by coming into contact with the protrusion 27 as the cartridge 2 is mounted. Thus, as the cartridge 2 is mounted, the cam 70 rotates the development unit 24 into the separation position. On the other hand, if a cartridge 2, to which the separating members 71 are remaining attached, and therefore, the development unit 24 of which is in the transportation separation position, that is, the development unit 24 of which has been further rotated from the standby separation position, is mounted into the cartridge bay 100, the protrusion 27 is in the position in which it does not come into contact with the cam 70. Incidentally, the separating members 71 and cartridge 2 in the second embodiment are structured the same as the separating members 71 and cartridge 2 in the first embodiment, except for the size of the separating member mounts 24*e* and 24*f*.

(Operation for Detecting Presence or Absence of Separating Members 71)

Figure 20:
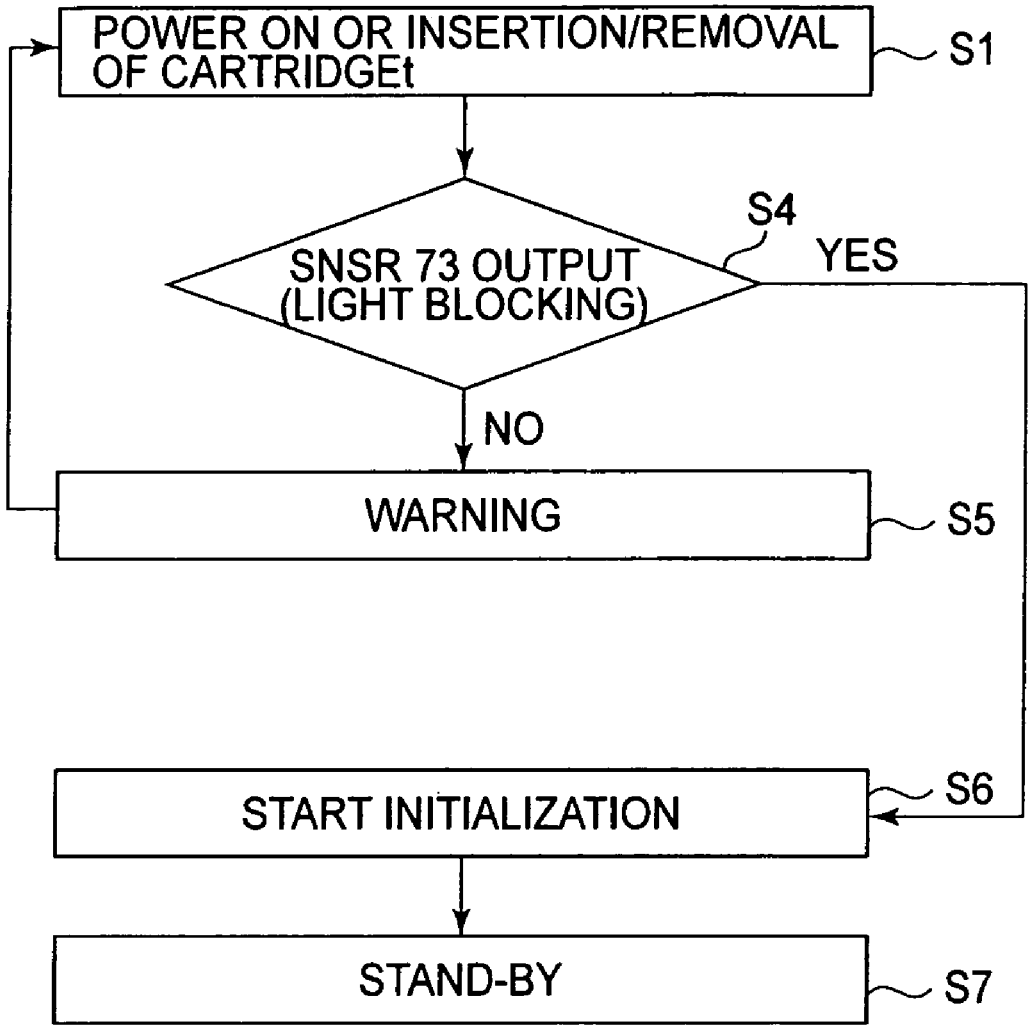
FIG. 20 is a flowchart of the operation for detecting the presence or absence of the separating members, in the second embodiment of the present invention.

Next, the operation for detection the presence or absence of the separating members 71 will be described. Referring to FIG. 20 which is a flowchart of the operation for detecting the presence or absence of the separating members 71, as a power source (FIG. 14) of the image forming apparatus 100 is turned on, or it is determined that the mounting of the cartridge 2 has been completed (S1), the controller 60 (FIG. 14) checks the state of the sensor 73 (controller 60 determines whether or not sensor 73 is being shielded from detection light) (S4). If the sensor 73 is not shielded from the detection light, the controller 60 issues, through a warning device 1, such a warning that prompts a user to remove the separating members 71 (S5). In this case, the image forming apparatus 100 does not carry out the initialization process (S5). In other words, the image forming apparatus does not start an image forming operation. Based on this warning, the user realizes that the separating members 71 are remaining attached to the cartridge 2. Incidentally, the warning method does not need to be limited to the above described one. Any of the warning methods mentioned in the description of the first embodiment may be optionally employed. Further, the above described FIG. 14 which is a block diagram of the image forming apparatus in the first embodiment is also applicable to the image forming apparatus in this embodiment, except for a few exceptions.

On the other hand, if the sensor 73 is shielded from the detection light (S4), the controller 60 determines that the separating members 71 have been removed. Then, the image forming apparatus 100 starts the initialization process (S6), putting thereby the cartridge 2 on standby for image formation (S7). In other words, it starts an image forming operation.

As described above, the controller 60 issues a warning, prompting thereby an operator to remove the detected separating members 71. In other words, if the sensor 73 detects that the development unit 24 is in the transportation separation position, the warning device 1 issues a warning, preventing thereby the malfunctions and/or damages which occur when an image forming operation is carried out while the separating members 71 are remaining attached to the cartridge 2.

Further in this embodiment, the presence or absence of the separation members 71 can be detected without the need for detecting whether or not the cartridge 2 has ever been used, the need for rotating the cam 70, or the need for carrying out the like operations. In other words, this embodiment is simpler in the operation for detecting the presence or absence of the separating members 71 than the first embodiment.

Figure 21:
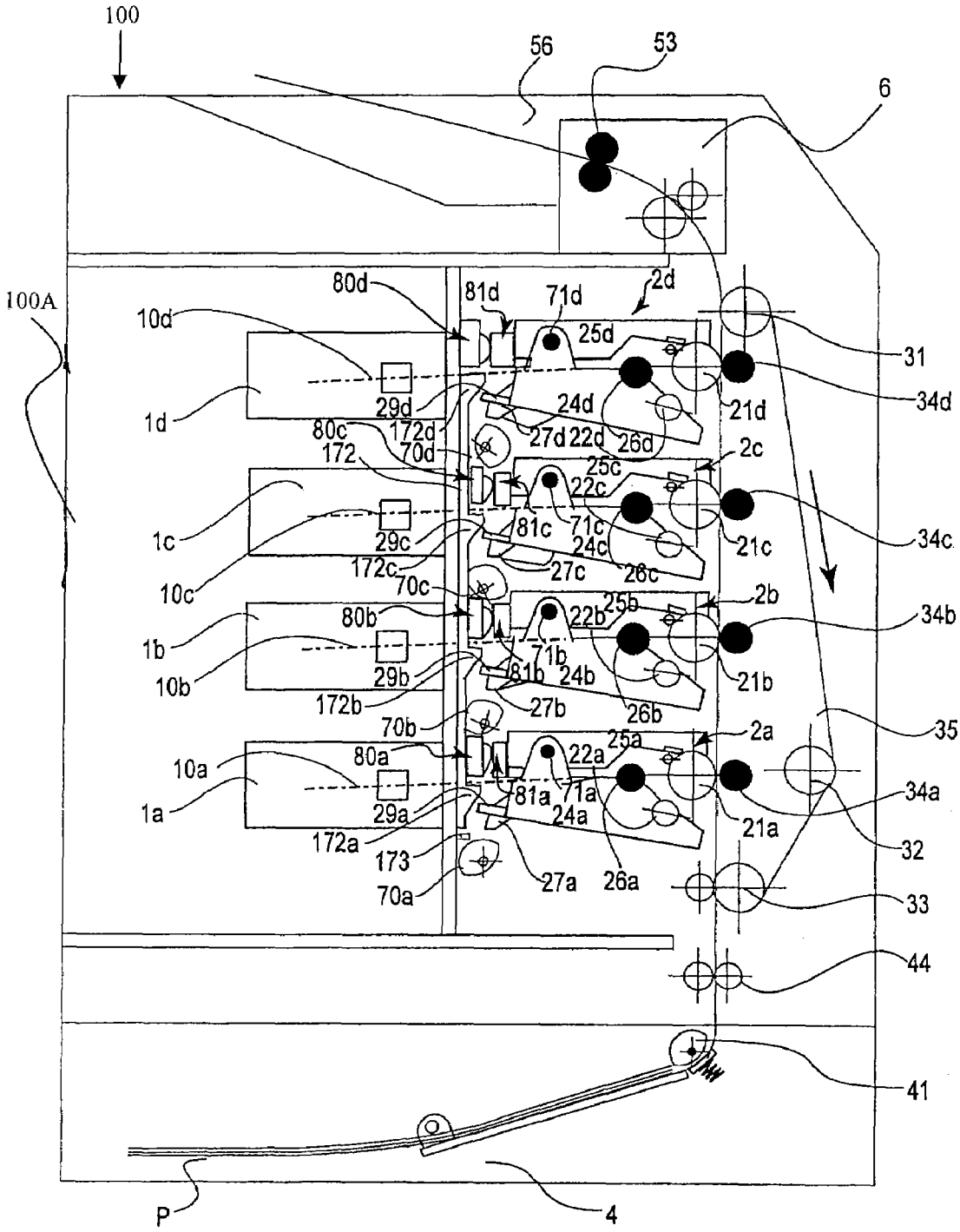
FIG. 21 is a sectional view of a modification of the image forming apparatus in the second embodiment of the present invention, showing the general structure thereof.

In the above, the structural arrangement in which the detection lever 72 is provided for each of the multiple cartridges 2 (cartridge bays) was described. However, the application of the present invention is not limited to the above described structural arrangement. For example, the present invention is also applicable to such a structural arrangement, shown in FIG. 21, that a single detection lever 172 and a single sensor 173 are employed to detect the presence or absence of all the separating members 71 of the multiple cartridges 2.

More specifically, in the case of such a structural arrangement, the detection lever 172 is provided with multiple protrusions 172*a*-172*d*, which match in position the multiple cartridges 2, one for one. Thus, any of the cartridges 2 is mounted into the apparatus main assembly 100A with the separating members 71 remaining attached to the cartridge 2, the corresponding protrusion (172*a*, 172*b*, 172*c*, and 172*d*) is pushed up by the protrusion 27 (27*a*, 27*b*, 27*c*, and 27*d*) as force catching portions of the cartridge 2, causing thereby the detection lever 172 to slide into the position in which the detection lever 172 does not shield the sensor 173 from the detection light.

The employment of such a structural arrangement makes it possible to reduce the component count of the separating member detecting means, and therefore, it can contribute to the reduction in the cost of the image forming apparatus 100, and also, to the simplification of the image forming apparatus 100. Further, after the sliding of the detection lever 172 (into position in which it shields sensor 173 from detection light), it is detected which cartridges 2 have never been used; it is possible to specify the cartridge bays of the apparatus main assembly 100A, which contain a cartridge (unused cartridge 2), to which the separating members 71 are remaining attached.

As will be evident from the descriptions of the preferred embodiments of the present invention, the present invention makes it possible to provide a process cartridge transportable while remaining mounted in the main assembly of an electrophotographic image forming apparatus, and an electrophotographic image forming apparatus in which such a process cartridge is removably mountable.

Further, the present invention makes it possible to provide a process cartridge, which allows the separating members remaining attached thereto, to be detected before an image forming operation is started, and an electrophotographic image forming apparatus in which such a process cartridge is removably mountable.

Further, the present invention makes it possible to provide a process cartridge which is not usable for an image forming operation when the separating members are remaining attached thereto, and an electrophotographic image forming apparatus in which such a process cartridge is removably mountable.

Further, the present invention makes it possible to provide a process cartridge, the photosensitive drum and development roller of which are prevented from being damaged by the vibrations which occur while an electrophotographic image forming apparatus is transported with the process cartridge(s) mounted in the main assembly of the apparatus, the impacts which result as an electrophotographic image forming apparatus is dropped while it is transported with the process cartridge mounted in the main assembly of the apparatus, or the like causes, and an electrophotographic image forming apparatus in which such a process cartridge is removably mountable.

Further, the present invention makes it possible to provide a process cartridge, the photosensitive drum and development roller of which suffer a smaller amount of frictional wear than a process cartridge based on the prior art, and an electrophotographic image forming apparatus in which such a process cartridge is removably mountable.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 130612/2005 and 080696/2006 filed Apr. 27, 2005 and Mar. 23, 2006 which are hereby incorporated by reference.

What is claimed is:

1. A process cartridge which is detachably mountable to a main assembly of an electrophotographic image forming apparatus for forming an image on a recording material and which is transportable in a state of being mounted in the main assembly of the apparatus, said process cartridge comprising:

an electrophotographic photosensitive drum;

a developing roller that develops an electrostatic latent image formed on said electrophotographic photosensitive drum with a developer in a state of being in contact to said electrophotographic photosensitive drum along a longitudinal direction thereof;

a drum unit supporting said electrophotographic photosensitive drum;

a developing unit supporting said developing roller, said developing unit being connected with said drum unit for rotation between a contact position where said developing roller is in contact with said electrophotographic photosensitive drum along the longitudinal direction and a separated position where said developing roller is separated from said electrophotographic photosensitive drum;

a force receiving portion that receives, from the main assembly of the apparatus, a force for moving said developing unit from the contact position to the separated position, with said process cartridge mounted in the main assembly of the apparatus;

a separation member that maintains said developing unit at a second separated position where said developing roller and said electrophotographic photosensitive drum are separated from each other, said separation member being mounted on said drum unit and said developing unit in a manner that said separation member permits mounting of said process cartridge to the main assembly of the apparatus with said separation member mounted thereon; and a detection portion, provided on said developing unit, usable by the main assembly of the apparatus to detect that said separation member is mounted, in the state of the process cartridge mounted in the main assembly of the apparatus.

2. A process cartridge according to claim 1, further comprising an urging member applying an urging force between said drum unit and said developing unit toward the contact position.

3. A process cartridge according to claim 1, further comprising a resisting portion that resists movement of said drum unit against the force received by said force receiving portion from the main assembly of the apparatus, said resisting portion resists the movement using the main assembly of the apparatus.

4. A process cartridge according to claim 1, wherein said force receiving portion is projected downwardly from a bottom surface in the state of said process cartridge mounted in the main assembly of the apparatus, and wherein said force receiving portion is disposed substantially at the center of said process cartridge with respect to a direction perpendicular to a mounting direction in which said process cartridge is mounted into the main assembly of the apparatus and at a leading portion with respect to the mounting direction.

5. A process cartridge according to claim 1, further comprising a storing element storing information indicative of the remaining life of said process cartridge and indicative of a non use state of said process cartridge, wherein said storing element is disposed adjacent one end portion of said process cartridge with respect to a direction perpendicular to a mounting direction in which the process cartridge is mounted into said main assembly of the apparatus, and said detection portion is disposed adjacent the same end portion at a leading portion of said process cartridge with respect to the mounting direction.

6. A process cartridge according to claim 1, wherein said separation member has a projected portion which projects beyond said drum unit and said developing unit in a state of being removably mounted on said drum unit and said developing unit, and said separation member is locked with said projected portion being along said drum unit and/or said developing unit so as to permit said process cartridge to be mounted into the main assembly of the apparatus with said separation member mounted thereto.

7. A process cartridge according to claim 1, wherein said separation member places said developing unit at the second separated position where said developing roller and said electrophotographic photosensitive drum are more remote from each other than at the separated position, when said separation member is mounted on said process cartridge.

8. An electrophotographic image forming apparatus for forming an image on a recording material, to which a process cartridge is detachably mountable and which is transportable with the process cartridge mounted therein, said apparatus comprising:

(a) detecting means;

(b) movable force applying means;

(c) said process cartridge including an electrophotographic photosensitive drum; a developing roller that develops an electrostatic latent image formed on said electrophotographic photosensitive drum with a developer in a state of being in contact to said electrophotographic photosensitive drum along a longitudinal direction thereof; a drum unit supporting said electrophotographic photosensitive drum; a developing unit supporting said developing roller, said developing unit being connected with said drum unit for rotation between a contact position where said developing roller is in contact with said electrophotographic photosensitive drum along the longitudinal direction and a separated position where said developing roller is separated from said electrophotographic photosensitive drum; a force receiving portion that receives, from the force applying means, a force for moving said developing unit from the contact position to the separated position, with said process cartridge mounted in a main assembly of said apparatus; a separation member that maintains said developing unit at a second separated position where said developing roller and said electrophotographic photosensitive drum are separated from each other, said separation member being mounted on said drum unit and said developing unit in a manner that said separation member permits mounting of said process cartridge to the main assembly of said apparatus with said separation member mounted thereon; and a detection portion, provided on said developing unit, usable by said detecting means to detect that said separation member is mounted, in the state of said process cartridge mounted in the main assembly of said apparatus;

(d) a mounting member that detachably mounts said process cartridge; and (e) feeding means that feeds the recording material.

9. An apparatus according to claim 8, further comprising control means for detecting the presence or absence of said separation member on the basis of a change of a signal detected by said detecting means when said force applying means is moved, in a state of said process cartridge mounted in said apparatus, before start of an image forming operation.

10. An apparatus according to claim 8, further comprising a notification member that prompts removal of said separation member when said detecting means detects the presence of said separation member.

* * * * *